US007239823B2

(12) United States Patent
Oguma et al.

(10) Patent No.: US 7,239,823 B2
(45) Date of Patent: Jul. 3, 2007

(54) ELECTROPHOTOGRAPHIC IMAGE FORMING APPARATUS, PROCESS CARTRIDGE AND DISCHARGE PREVENTING MECHANISM

(75) Inventors: Toru Oguma, Shizuoka (JP); Hideshi Kawaguchi, Shizuoka (JP); Takeshi Sugita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/415,185

(22) Filed: May 2, 2006

(65) Prior Publication Data

US 2006/0193653 A1 Aug. 31, 2006

Related U.S. Application Data

(62) Division of application No. 10/900,315, filed on Jul. 28, 2004, now Pat. No. 7,062,192.

(30) Foreign Application Priority Data

Feb. 27, 2004 (JP) ..... 2004-055519
Jul. 12, 2004 (JP) ..... 2004-205324

(51) Int. Cl.
*G03G 15/00* (2006.01)

(52) U.S. Cl. ..... 399/90; 399/89; 399/107; 399/111; 399/113

(58) Field of Classification Search ..... 399/88–90, 399/107, 111, 113, 114
See application file for complete search history.

(56) References Cited

U.S. PATENT DOCUMENTS 4,588,273 A 5/1986 Nagata ..... 396/208
5,650,841 A 7/1997 Matsuda et al. ..... 399/111
5,652,647 A 7/1997 Yashiro et al. ..... 399/111

(Continued)

FOREIGN PATENT DOCUMENTS

JP 07-77921 3/1995

(Continued)

OTHER PUBLICATIONS

Patent Abstracts of Japan, vol. 2000, No. 11, Jan. 3, 2001, Abstract of Japan Doc. No. 2000-219360.

(Continued)

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

An electrophotographic image forming apparatus on which a process cartridge is detachably mountable forms an image on a recording medium, and has a main body electrical contact electrically connected to a cartridge electrical contact when the cartridge is mounted on an apparatus main body, an electrically grounded electrically conductive discharge preventing member for effecting discharge between it and a charged foreign substance to thereby prevent discharge from occurring between the foreign substance and the main body electrical contact when the foreign substance has entered the apparatus main body on which the process cartridge is not mounted. The discharge preventing member is movable between a first position located in the entry route of the cartridge and a second position retracted from the first position and located outside the entry route. The apparatus also has an actuating member for moving the discharge preventing member from the first to the second position.

15 Claims, 20 Drawing Sheets

U.S. PATENT DOCUMENTS

| | | | | |
|---|---|---|---|---|
| 5,768,658 | A | 6/1998 | Watanabe et al. | 399/111 |
| 5,930,560 | A | 7/1999 | Sawaki | 399/111 |
| 5,953,562 | A | 9/1999 | Kawaguchi et al. | 399/117 |
| 6,011,941 | A | 1/2000 | Takashima et al. | 399/111 |
| 6,084,622 | A | 7/2000 | Sugiura et al. | 347/170 |
| 6,097,909 | A | 8/2000 | Watanabe et al. | 399/111 |
| 6,272,299 | B1 | 8/2001 | Numagami et al. | 399/111 |
| 6,311,026 | B1 | 10/2001 | Higeta et al. | 399/13 |
| 6,377,759 | B1 | 4/2002 | Abe et al. | 399/27 |
| 6,400,914 | B1 * | 6/2002 | Noda et al. | 399/90 |
| 6,512,895 | B2 | 1/2003 | Sakarai et al. | 399/13 |
| 6,571,070 | B2 | 5/2003 | Oguma et al. | 399/27 |
| 6,587,650 | B2 | 7/2003 | Yokoi et al. | 399/27 |
| 6,594,454 | B2 | 7/2003 | Oguma et al. | 399/90 |
| 6,704,525 | B2 | 3/2004 | Oguma et al. | 399/27 |
| 6,804,475 | B2 | 10/2004 | Oguma et al. | 399/27 |
| 6,804,476 | B2 | 10/2004 | Yokoi et al. | 399/27 |
| 6,993,264 | B2 | 1/2006 | Oguma et al. | 399/90 |
| 2002/0012542 | A1 | 1/2002 | Karakama et al. | 399/27 |
| 2002/0021908 | A1 | 2/2002 | Matsumoto et al. | 399/27 |
| 2002/0172521 | A1 | 11/2002 | Oguma et al. | 399/27 |
| 2003/0235416 | A1 | 12/2003 | Mochizuki et al. | 399/27 |
| 2005/0069338 | A1 | 3/2005 | Oguma et al. | 399/90 |
| 2005/0191079 | A1 | 9/2005 | Yokoi et al. | 399/90 |

FOREIGN PATENT DOCUMENTS

| | | |
|---|---|---|
| JP | 10-069140 | 3/1998 |
| JP | 10-228224 | 8/1998 |
| JP | 2000-219360 | 8/2000 |
| JP | 2001-19222 | 1/2001 |
| JP | 2003-195723 A | 7/2003 |

OTHER PUBLICATIONS

Patent Abstracts of Japan, vol. 2000, No. 16, May 8, 2001, Abstract of Japan Doc. No. 2001-019222.

Patent Abstracts of Japan, vol. 1998, No. 08, Jun. 30, 1998, Abstract of Japan Doc. No. 10-069140.

Notification of Reason for Refusal, issued Oct. 27, 2006 in Japanese Application No. 2004-205324 and English translation thereof.

Notification of Reason for Refusal, issued May 3, 2006 from the Korean Patent Office and English translation thereof.

* cited by examiner

ELECTROPHOTOGRAPHIC IMAGE FORMING APPARATUS, PROCESS CARTRIDGE AND DISCHARGE PREVENTING MECHANISM

CROSS-REFERENCE TO RELATED APPLICATION

This is a divisional application of U.S. patent application Ser. No. 10/900,315, filed Jul. 28, 2004, now U.S. Pat. No. 7,062,192.

This application claims priorities from Japanese Patent Application No. 2004-055519 filed Feb. 27, 2004 and Japanese Patent Application No. 2004-205324 filed Jul. 12, 2004, which are hereby incorporated by reference herein.

BACKGROUND OF THE INVENTION

Field of the Invention and Related Art

The invention relates to an electrophotographic image forming apparatus on which a process cartridge is detachably mountable, a process cartridge mounted to this electrophotographic image forming apparatus, and a discharge preventing mechanism.

The electrophotographic image forming apparatus is an apparatus for forming an image on a recording medium (for example, recording paper, an OHP sheet or the like) by the use of an electrophotographic image forming process. This term covers, for example, an electrophotographic copying machine, an electrophotographic printer, etc.

Also, the process cartridge refers to at least one of a charging member and a developing member as process means and an electrophotographic photosensitive member integrally made into a cartridge which is detachably mountable on an electrophotographic image forming apparatus main body.

In an electrophotographic image forming apparatus of a process cartridge type, the mounting and dismounting of a process cartridge with respect to an electrophotographic image forming apparatus main body (hereinafter referred to as the "apparatus main body") can be done by a user himself without resort to a serviceman. So, the operability of the image forming apparatus can be markedly improved.

In such an electrophotographic image forming apparatus, it is necessary to apply a voltage to a charging member for charging an electrophotographic photosensitive member of the process cartridge, or a developing member or the like for developing an electrostatic latent image formed on the electrophotographic photosensitive member. Also, in some cases, the giving and receiving of a voltage and a detection signal (output voltage) to developer amount detecting means of a capacitance detection type or the like are effected.

So, it is necessary to effect electrical connection between the process cartridge and the apparatus main body when the process cartridge has been mounted to the apparatus main body. Therefore, a cartridge electrical contact has heretofore been provided on the frame member of the process cartridge. On the other hand, a main body electrical contact to be electrically connected to this cartridge electrical contact is provided on the apparatus main body. Thereby, the cartridge electrical contact and the main body electrical contact are connected together when the process cartridge is mounted to the apparatus main body. As a result, a voltage and a signal are transmitted and received between the apparatus main body and the process cartridge.

Now, during the interchange of the process cartridge or when the jam of a recording medium has occurred, an operator performs the operation of mounting and dismounting the process cartridge.

If at this time, the process cartridge taken out of the apparatus main body bears static electricity, when the process cartridge is inserted into the apparatus main body, the static electricity may be discharged to the electrical contact exposed in the interior of the apparatus main body. Some image forming apparatuses are provided with a charge eliminating member in the apparatus main body in order to prevent an inconvenience caused by electrostatic noise being applied to an electric circuit in the main body due to such discharge.

In the conventional electrophotographic image forming apparatus, however, the operator sometimes brings a foreign substance such as his hand into the apparatus main body to effect jam treatment (when a recording medium is jammed in the apparatus main body, taking the jammed recording medium out of the apparatus main body) or the maintenance of the apparatus. If at that time, the foreign substance such as the operator's hand (body) is charged, there has been the possibility that discharge occurs from the foreign substance such as the operator's hand to an electrical contact in the interior of the apparatus main body (e.g. U.S. Pat. No. 5,930,560).

SUMMARY OF THE INVENTION

It is an object of the present invention to provide an electrophotographic image forming apparatus, a process cartridge and a discharge preventing mechanism which, when a charged foreign substance has come into the electrophotographic image forming apparatus having the process cartridge not mounted thereon, can prevent discharge from occurring between the foreign substance and a main body electrical contact provided in an apparatus main body.

It is another object of the present invention to provide an electrophotographic image forming apparatus, a process cartridge and a discharge preventing mechanism in which electrostatic noise is not applied to a main body electrical contact and which can prevent the destruction of an electrical element provided in an electric circuit, thereby preventing the damage of the electric circuit provided in an apparatus main body.

It is another object of the present invention to provide an electrophotographic image forming apparatus, a process cartridge and a discharge preventing mechanism which can prevent man's sweat or grease in an apparatus main body from adhering to a main body electrical contact to thereby cause faulty conduction, and which is improved in the reliability of the electrical connection between a cartridge electrical contact and the main body electrical contact.

It is another object of the present invention to provide an electrophotographic image forming apparatus, a process cartridge and a discharge preventing mechanism in which an operator need not perform any special operation and which can prevent discharge to a main body electrical contact and the damage of the electric circuit of an apparatus main body caused thereby, and can be improved in the reliability of the electrical connection between a cartridge electrical contact and the main body electrical contact.

It is another object of the present invention to provide an electrophotographic image forming apparatus having an electrically grounded, electrically conductive discharge preventing member which, when a charged foreign substance has entered an apparatus main body having a process cartridge not mounted thereon, effects discharge between it and the foreign substance to thereby prevent discharge from occurring between the foreign substance and a main body electrical contact, and which is movable between a first position located in the entry route of the process cartridge and a second position retracted from the first position and located outside the entry route, a process cartridge detachably mountable thereon, and a discharge preventing mechanism.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An electrophotographic image forming apparatus, a process cartridge and a discharge preventing mechanism according to the present invention will hereinafter be described with reference to the drawings.

First Embodiment

[1. General Construction and Operation of the Electrophotographic Image Forming Apparatus]

Figure 1:
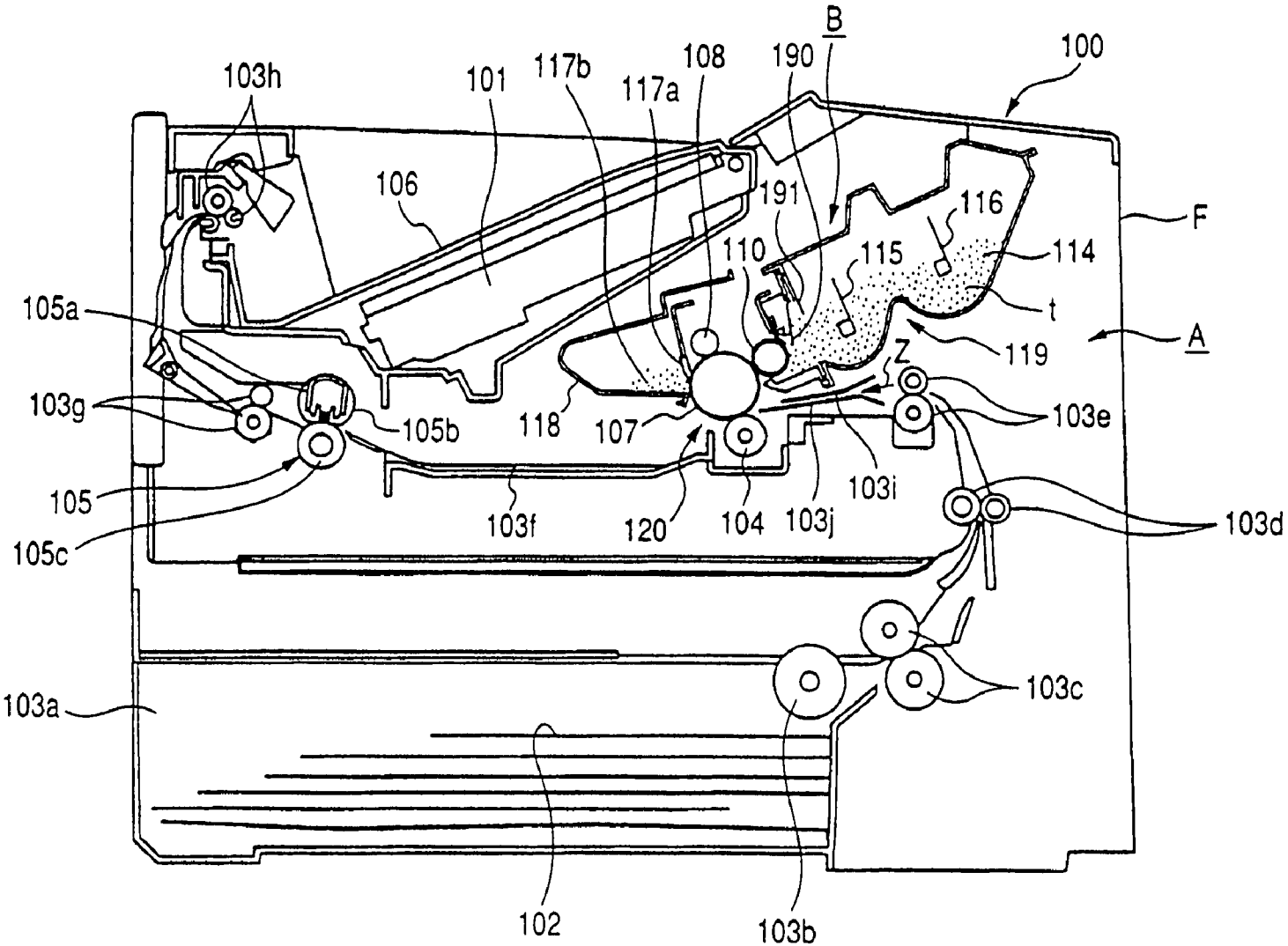
FIG. 1 is a cross-sectional view of an image forming apparatus according to an embodiment of the present invention.

Reference is first made to FIG. 1 to describe the general construction and operation of an embodiment of an electrophotographic image forming apparatus (hereinafter referred to as the "image forming apparatus") 100 to which a process cartridge (hereinafter referred to as the "cartridge") B is detachably mountable. FIG. 1 is a cross-sectional view showing the general construction of the image forming apparatus 100.

A laser beam printer will hereinafter be described as an example of the image forming apparatus 100. The image forming apparatus 100 forms an image on a recording medium (e.g. recording paper, an OHP sheet, cloth or the like) by the use of an electrophotographic image forming process in accordance with an image information signal transmitted from a personal computer (or a scanner device or the like) connected for communication with an apparatus main body A.

The image forming apparatus 100 has a drum-shaped electrophotographic photosensitive member (hereinafter referred to as the "photosensitive drum") 107. Image forming will first be described. The surface of the photosensitive drum 107 being rotated is uniformly charged by a charging roller 108 as a charging member. Then, a laser beam conforming to image information is applied from optical means 101 having a laser diode, a polygon mirror, a lens and a reflecting mirror (all being not shown) to the photosensitive drum 107. Thereby, an electrostatic latent image conforming to the image information is formed on the photosensitive drum 107. A developer is supplied to this electrostatic latent image by a developing roller 110 as a developing member. As the result, a developer image is formed on the photosensitive drum 107.

On the other hand, in synchronism with the formation of the developer image on the photosensitive drum 107, one of the recording media 102 set on a cassette 103*a* is conveyed by a feed roller 103*b* and pairs of conveying rollers 103*c*, 103*d* and 103*e*. Further, the recording medium 102 is conveyed to a transferring position in a conveying direction indicated by arrow Z along an upper transfer guide 103*i* and a lower transfer guide 103*j* as a portion of a conveying guide for guiding the conveying direction of the recording medium 102. At the transferring position, a transfer roller 104 as transferring means is disposed in opposed relationship with the photosensitive drum 107. A voltage is applied to this transfer roller 104, whereby the developer image on the photosensitive drum 107 is transferred to the recording medium 102.

The recording medium 102 to which the developer image has been transferred is conveyed to fixing means 105 through an ante-fixing guide 103*f*. The fixing means 105 is provided with a driving roller 105*c* and a fixing roller 105*b* containing a heater 105*a* therein. It applies heat and pressure to the passing recording medium 102 to thereby fix the developer image on the recording medium 102. Thereafter, the recording medium 102 is conveyed by pairs of rollers 103*g* and 103*h*. Then, the recording medium 102 is discharged onto a tray 106.

The feed roller 103*b*, the pairs of conveying rollers 103*c*, 103*d*, 103*e*, the upper transfer guide 103*i*, the lower transfer guide 103*j*, the ante-fixing guide 103*f* and the pairs of rollers 103*g*, 103*h* together constitute conveying means for the recording medium 102.

[2. Cartridge]

Figure 2:
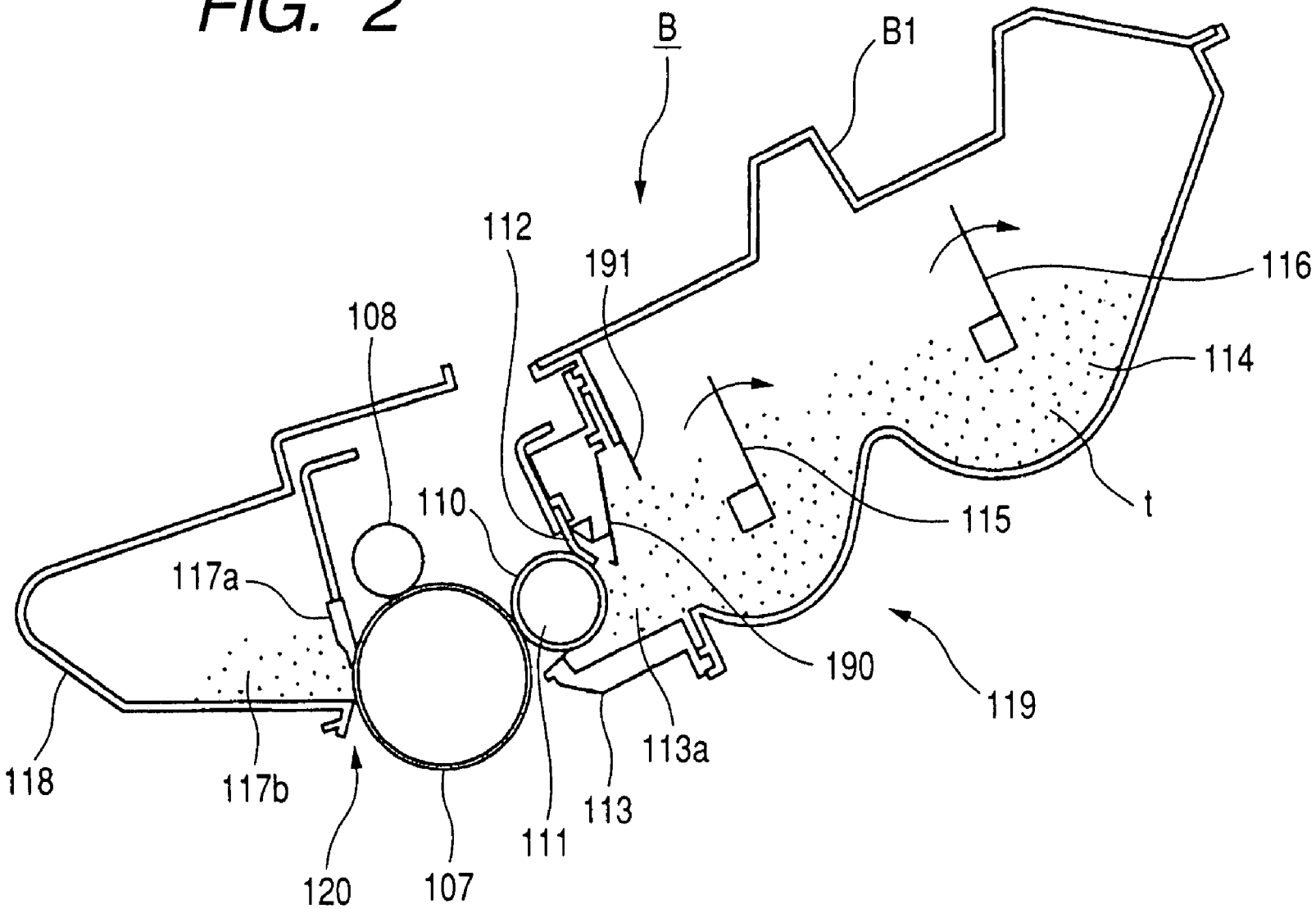
FIG. 2 is a cross-sectional view of a process cartridge according to an embodiment of the present invention.

The cartridge B will now be described with reference also to FIG. 2. FIG. 2 is a cross-sectional view of the cartridge B.

The cartridge B has the photosensitive drum 107. When as shown in FIG. 1, the cartridge B is mounted on the apparatus main body A, the photosensitive drum 107 receives a driving force from the apparatus main body A and is rotated.

The charging roller 108 as a charging member is provided in opposed relationship with the outer peripheral surface of the photosensitive drum 107. The charging roller 108 charges the photosensitive drum 107 by a voltage (charging bias) being applied thereto from the apparatus main body A. Also, the charging roller 108 is provided in contact with the photosensitive drum 107. The charging roller 108 is driven to rotate by the photosensitive drum 107. When the cartridge B is mounted on the apparatus main body A, the charging roller 108 receives a voltage from the apparatus main body A through a charging output electrical contact 144*a* (see FIG. 6) as a main body electrical contact, and a charging input electrical contact 141*a* (see FIG. 8) as a cartridge electrical contact. The charging output electrical contact 144*a* is an electrical contact of the apparatus main body A. Also, the charging input electrical contact 141*a* is an electrical contact of the cartridge B. The photosensitive drum 107 is charged by this voltage.

Also, the cartridge B has the developing roller 110 as a developing member. The developing roller 110 supplies a developer t to the developing area of the photosensitive drum 107. By the use of this developer t, the developing roller 110 develops the electrostatic latent image formed on the photosensitive drum 107. The developing roller 110 contains a magnet roller (stationary magnet) 111 therein.

A developing blade 112 as a developer amount regulating member is provided in abutting relationship with the peripheral surface of the developing roller 110. The developing blade 112 regulates the amount of developer t adhering to the peripheral surface of the developing roller 110. Also, the developing blade 112 imparts triboelectric charges to the developer t.

The developer t contained in a developer container 114 is fed out to a developing chamber 113*a* by the rotation of agitating members 115 and 116. On the other hand, the developing roller 110 to which a voltage (developing bias) has been applied is being rotated. Thereby, a layer of developer t to which the triboelectric charges have been imparted by the developing blade 112 is formed on the surface of the developing roller 110. Then, the developer t moves to the photosensitive drum 107 in conformity with the latent image. Thus, the latent image is developed.

When the cartridge B has been mounted on the apparatus main body A, the developing roller 110 receives a voltage from the apparatus main body A through a developing output electrical contact 161*a* (see FIG. 6) as a main body electrical contact, and a developing input electrical contact (developing bias contact) 160*a* (see FIG. 8) as a cartridge electrical contact. The developing roller 110 functions by this voltage and develops the electrostatic latent image.

The cartridge B according to the present embodiment is provided with a first detecting electrode 190 and a second detecting electrode 191 as developer amount detecting means which can detect the remaining amount of the developer t in accordance with the consumption thereof. The first detecting electrode 190 and the second detecting electrode 191 are provided at locations at which they contact with the developer. Further, the first detecting electrode 190 and the second detecting electrode 191 are disposed at such locations that the areas of contact thereof with the developer fluctuate as the developer t is decreased. According to the present embodiment, the first detecting electrode 190 and the second detecting electrode 191 are disposed along the lengthwise direction of the developing roller 110 so as to be opposed to the developing roller 110. In this state, a voltage is applied to one of the first detecting electrode 190 and the second detecting electrode 191. By doing so, charges conforming to the capacitance between the two electrodes 190 and 191 are induced. The output voltage at this time is then measured by the apparatus main body A to thereby detect the developer amount.

Figure 6:
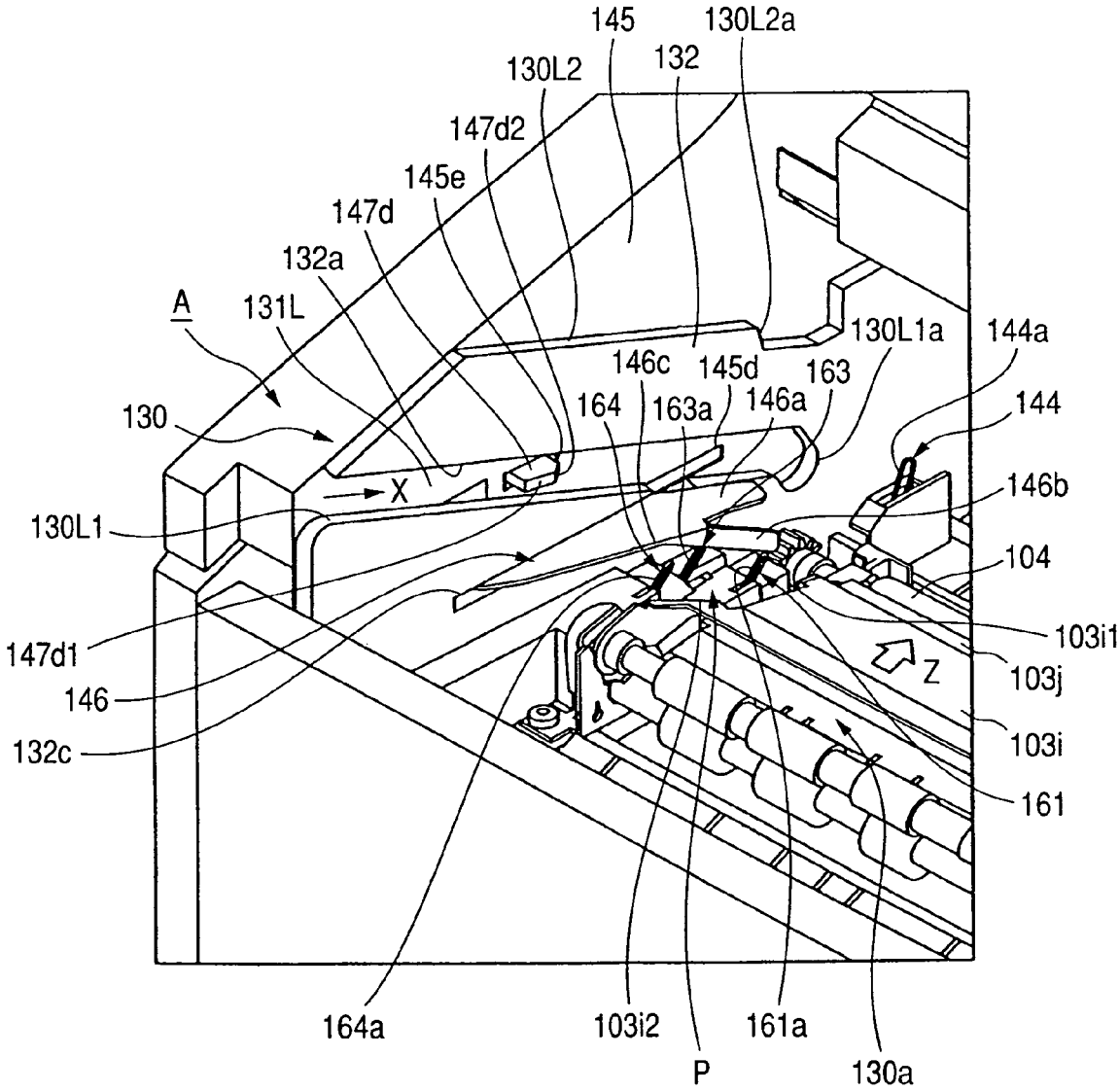
FIG. 6 is a perspective view showing the cartridge mounting portion of the image forming apparatus according to the embodiment of the present invention and a discharge preventing member.

Here, a voltage is applied from the apparatus main body A to one of the first detecting electrode 190 and the second detecting electrode 191 for detecting the developer amount. Also, a developer amount detection voltage (detection signal) is outputted from the other of the first detecting electrode 190 and the second detecting electrode 191 to the apparatus main body A. For this purpose, a first cartridge remaining amount detecting contact 188*a* and a second cartridge remaining amount detecting contact 189*a* as cartridge electrical contacts are provided in the cartridge B, as shown in FIG. 6.

In the present embodiment, the first cartridge remaining amount detecting contact 188*a* is connected to the first detecting electrode 190. Also, the second cartridge remaining amount detecting contact 189*a* is connected to the second detecting electrode 191.

The developer image formed on the photosensitive drum 107 by the aforedescribed developing operation is transferred to the recording medium 102 by the transfer roller 104. An elastic cleaning blade 117*a* as a cleaning member is disposed in opposed relationship with the outer peripheral surface of the photosensitive drum 107. The tip end of the cleaning blade 117*a* abuts against the photosensitive drum 107. After the developer image has been transferred to the recording medium 102, any residual developer t on the photosensitive drum 107 is removed by the cleaning blade 117*a*. The developer t removed from the surface of the photosensitive drum 107 by the cleaning blade 117*a* is contained in a removed developer reservoir 117*b*.

The cartridge B is integrally constituted by a developing unit 119 and a drum unit 120. The developing unit 119 is constituted by a developing frame member 113 which is a portion of a cartridge frame member B1. Further, the developing unit 119 has the developing roller 110, the developing blade 112, the developing chamber 113*a*, the developer container 114, the agitating members 115, 116, the first detecting electrode 190 and the second detecting electrode 191. Also, the drum unit 120 is constituted by a drum frame member 118 which is a portion of the cartridge frame member B1. Further, the drum unit 120 has the photosensitive drum 107, the cleaning blade 117*a*, the removed developer reservoir 117*b* and the charging roller 108.

Also, the developing unit 119 and the drum unit 120 are pivotally coupled together by a pin (not shown). The developing roller 110 is urged against the photosensitive drum 107 by a resilient member (not shown) provided between the two units 119 and 120.

[3. Mounting and Dismounting of the Cartridge]

A description will now be provided of the mounting and dismounting of the cartridge B with respect to the apparatus main body A.

Figure 3:
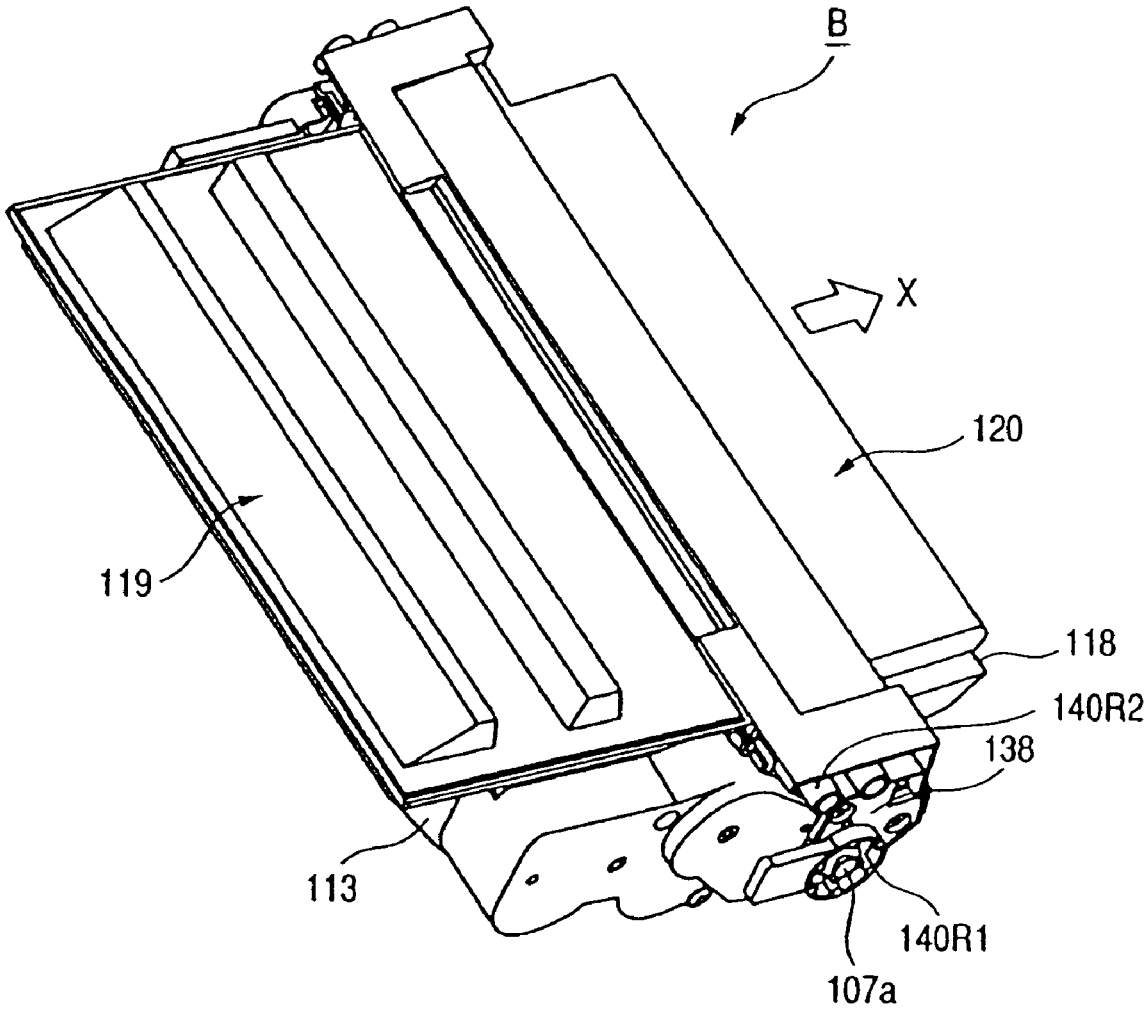
FIG. 3 is a perspective view of the process cartridge according to the embodiment of the present invention.
Figure 4:
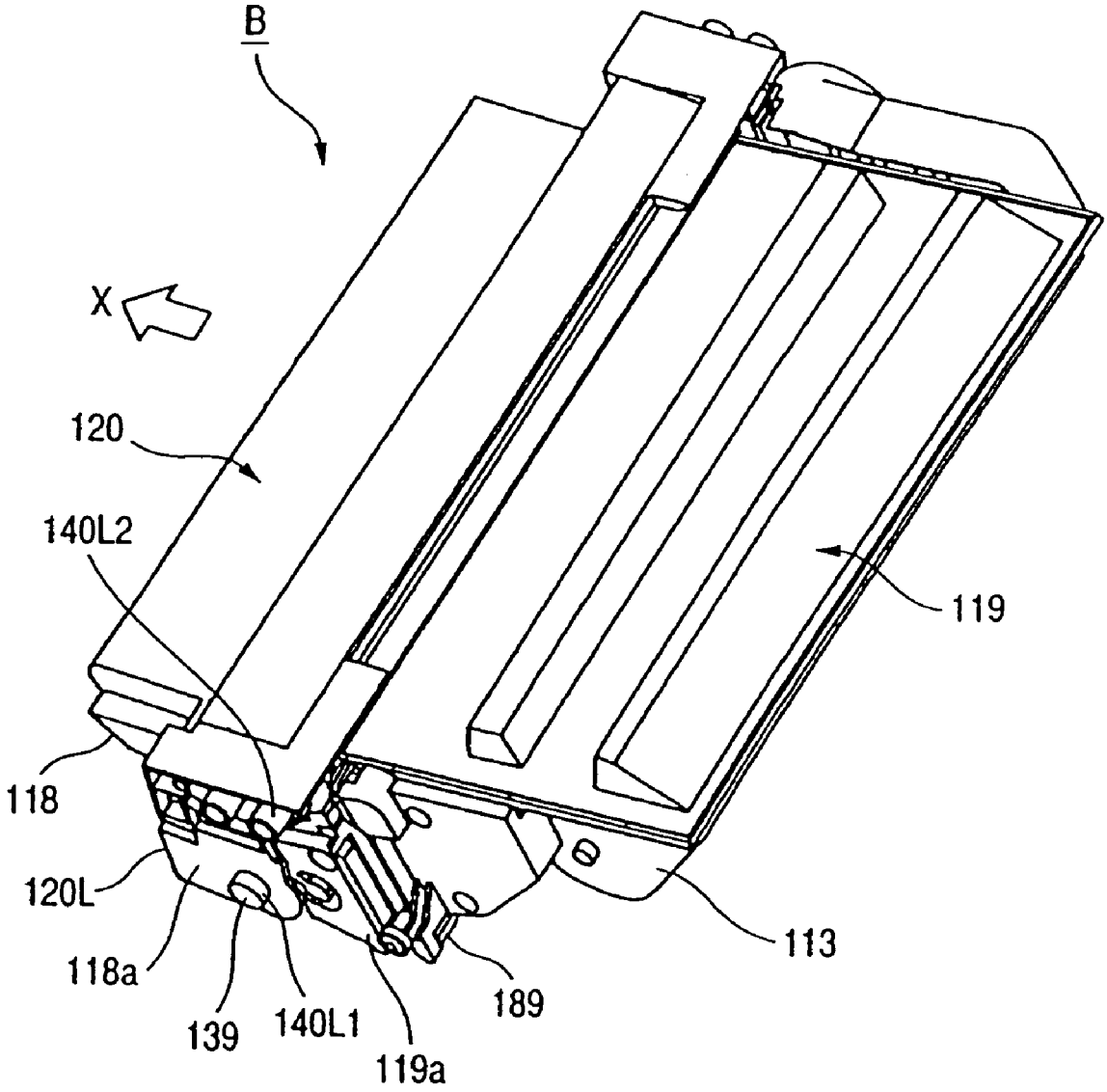
FIG. 4 is a perspective view of the process cartridge according to the embodiment of the present invention.

As shown in FIG. 3, a first right cartridge guide 140R1 and a second right cartridge guide 140R2 as mounting guide members are provided on a lengthwise end (the right end as viewed in a direction X in which the cartridge B is mounted) of the drum unit 120. The first right cartridge guide 140R1 is a portion of a drum bearing 138 for supporting one end of the photosensitive drum 107. As shown in FIG. 4, a first left cartridge guide 140L1 and a second left cartridge guide 140L2 as mounting guide members are provided on the lengthwise other end (the left end as viewed in the direction X in which the cartridge B is mounted) of the drum unit 120. The first left cartridge guide 140L1 is constructed on the outer end portion of a drum shaft 139 for supporting the other end of the photosensitive drum 107. The aforedescribed mounting guide members guide the cartridge B in a mounting direction when the cartridge B is mounted on the apparatus main body A.

Figure 5:
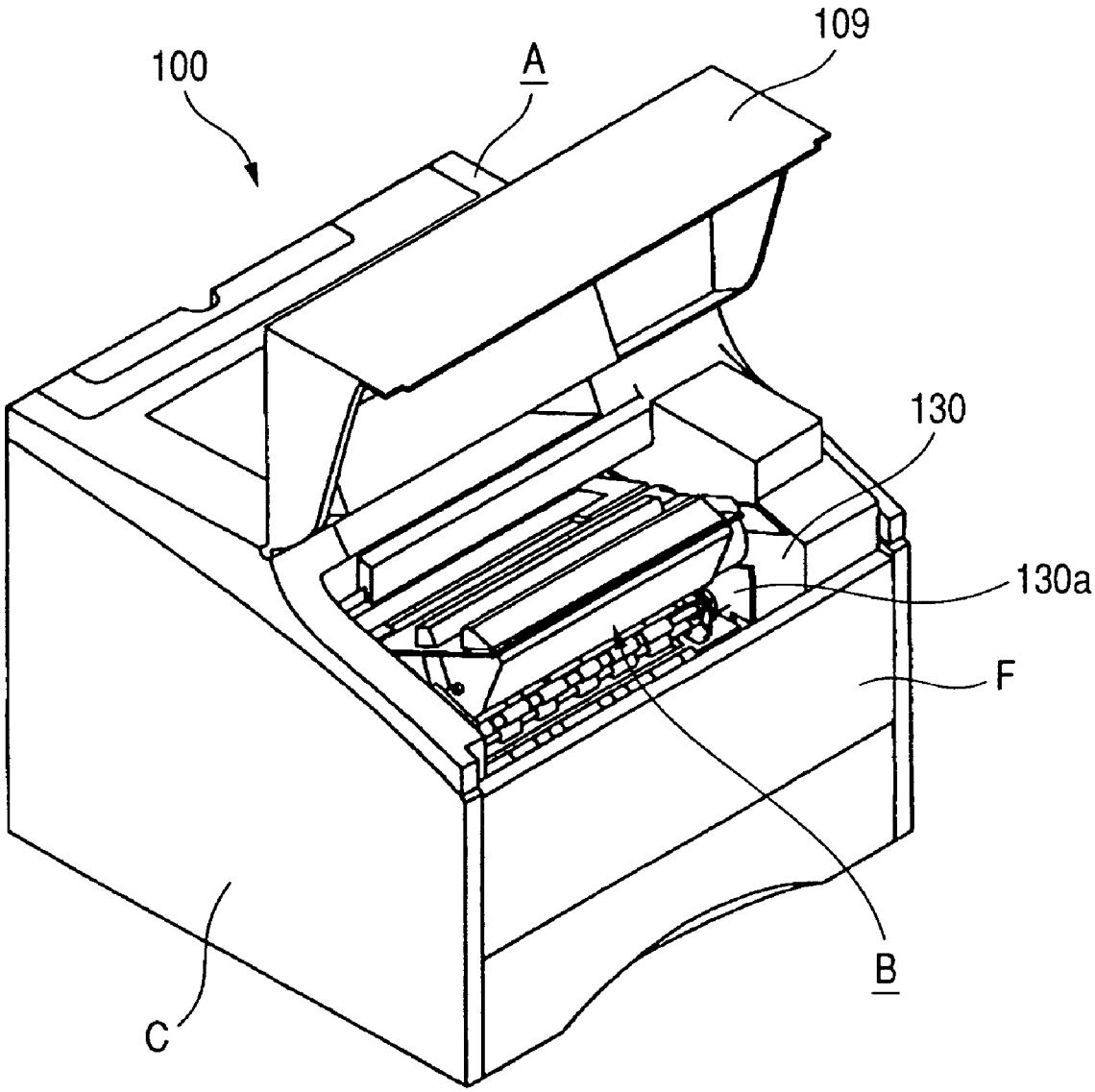
FIG. 5 is a perspective view of the image forming apparatus according to the embodiment of the present invention.

As shown in FIG. 5, a door 109 provided on the apparatus main body A is opened by the operator when the cartridge B is mounted on the apparatus main body A. In the present embodiment, this side of the door 109 with respect to the direction X in which the cartridge B is mounted is upwardly opened. Thus, the cartridge B is detachably mounted with respect to cartridge mounting means 130 provided in the apparatus main body A.

Figure 7:
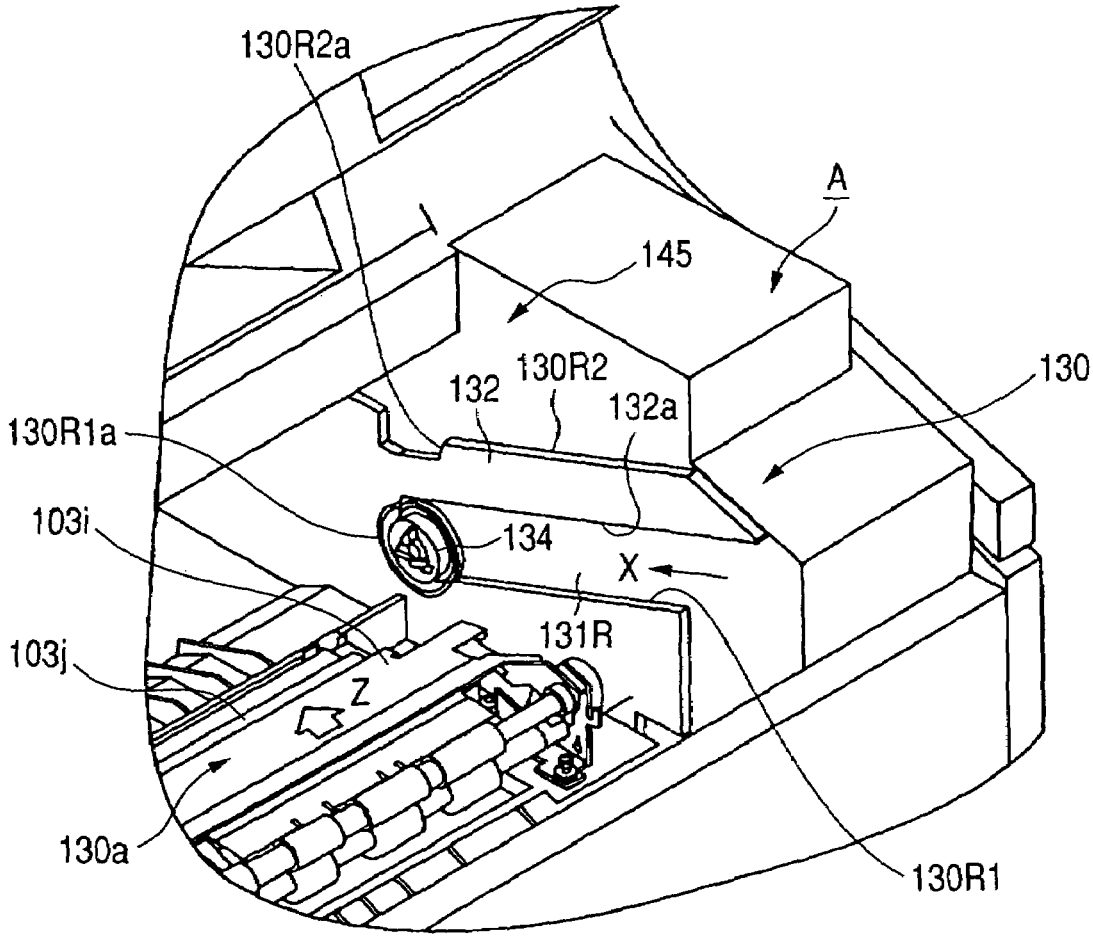
FIG. 7 is a perspective view showing the cartridge mounting portion of the image forming apparatus according to the embodiment of the present invention.

As shown in FIG. 7, the cartridge mounting means 130 has a first right main body guide 130R1 and a second right main body guide 130R2 in the right half of the apparatus main body A as viewed in the direction X in which the cartridge B is mounted. Also, as shown in FIG. 6, the cartridge mounting means 130 has a first left main body guide 130L1 and a second left main body guide 130L2 in the left half of the apparatus main body A as viewed in the direction X in which the cartridge B is mounted. When the cartridge B is to be mounted on the apparatus main body A, the first right cartridge guide 140R1 and the second right cartridge guide 140R2 (FIG. 3) are guided along the first right main body guide 130R1 and the second right main body guide 130R2, respectively. Also, the first left cartridge guide 140L1 and the second left cartridge guide 140L2 (FIG. 4) are guided along the first left main body guide 130L1 and the second left main body guide 130L2, respectively. Then, the cartridge B is inserted into a cartridge mounting portion 130*a*.

In the present embodiment, the first right main body guide 130R1, the second right main body guide 130R2, the first left main body guide 130L1 and the second left main body guide 130L2 are provided on an inner side plate (frame member) 132. The inner side plate 132 is fixed in close contact with the inner side of a side plate 145 of the apparatus main body A. The inner side plate 132 is cut away into a predetermined shape. An upper end surface forming a level difference with respect to the side plate 145 provides the first right main body guide 130R1, the second right main body guide 130R2, the first left main body guide 130L1 and the second left main body guide 130L2. A groove 131L as a main body guide is formed between the first left main body guide 130L1 and the lower end surface 132*a* of the inner side plate 132 opposed substantially parallel thereto. Likewise, a groove 131R as a main body guide is formed between the right main body guide 130R1 and the lower end surface 132*a* of the inner side plate 132 opposed substantially parallel thereto. The grooves 131L and 131R guide the cartridge B to the cartridge mounting portion 130*a* in the apparatus main body A.

The cartridge B is such that the first right cartridge guide 140R1 is fitted to the positioning portion 130R1*a* of the first right main body guide 130R1. Further, the second right cartridge guide 140R2 abuts against the positioning portion 130R2*a* of the second right main body guide 130R2. Also, the first left cartridge guide 140L1 is fitted to the positioning portion 130L1*a* of the first left main body guide 130L1. Further, the second left cartridge guide 140L2 abuts against the positioning portion 130L2*a* of the second left main body guide 130L2. Thus, the cartridge B is positioned on the cartridge mounting portion 130*a* in the apparatus main body A. As described above, the cartridge B is detachably mounted on the cartridge mounting portion 130*a* by the mounting means 130. The cartridge B becomes capable of performing an image forming operation by being mounted on the cartridge mounting portion 130*a*.

The cartridge mounting portion 130*a* is a space occupied by the cartridge B positioned relative to the apparatus main body A by the cartridge mounting means 130. Also, the route on which the cartridge B moves to the cartridge mounting portion 130*a* during the mounting of the cartridge B is the entry route of the cartridge B.

A coupling 134 as a driving force transmitting portion for transmitting drive to the cartridge B is provided in the apparatus main body A. When the cartridge B is to be mounted, the coupling 134 is retracted. Accordingly, the coupling 134 does not hinder the mounting of the cartridge B. Also, a coupling 107*a* (FIG. 3) as a driving force receiving portion for receiving the driving force the apparatus main body A is provided on the cartridge B. Incidentally, when the cartridge door 109 is closed, the coupling 107*a* of the cartridge B and the coupling 134 of the apparatus main body side are connected together. Thus, the cartridge B receives from the apparatus main body A a driving force for rotating the photosensitive drum 107.

[4. Electrical Contacts of the Apparatus Main Body A and the Cartridge B]

Figure 8:
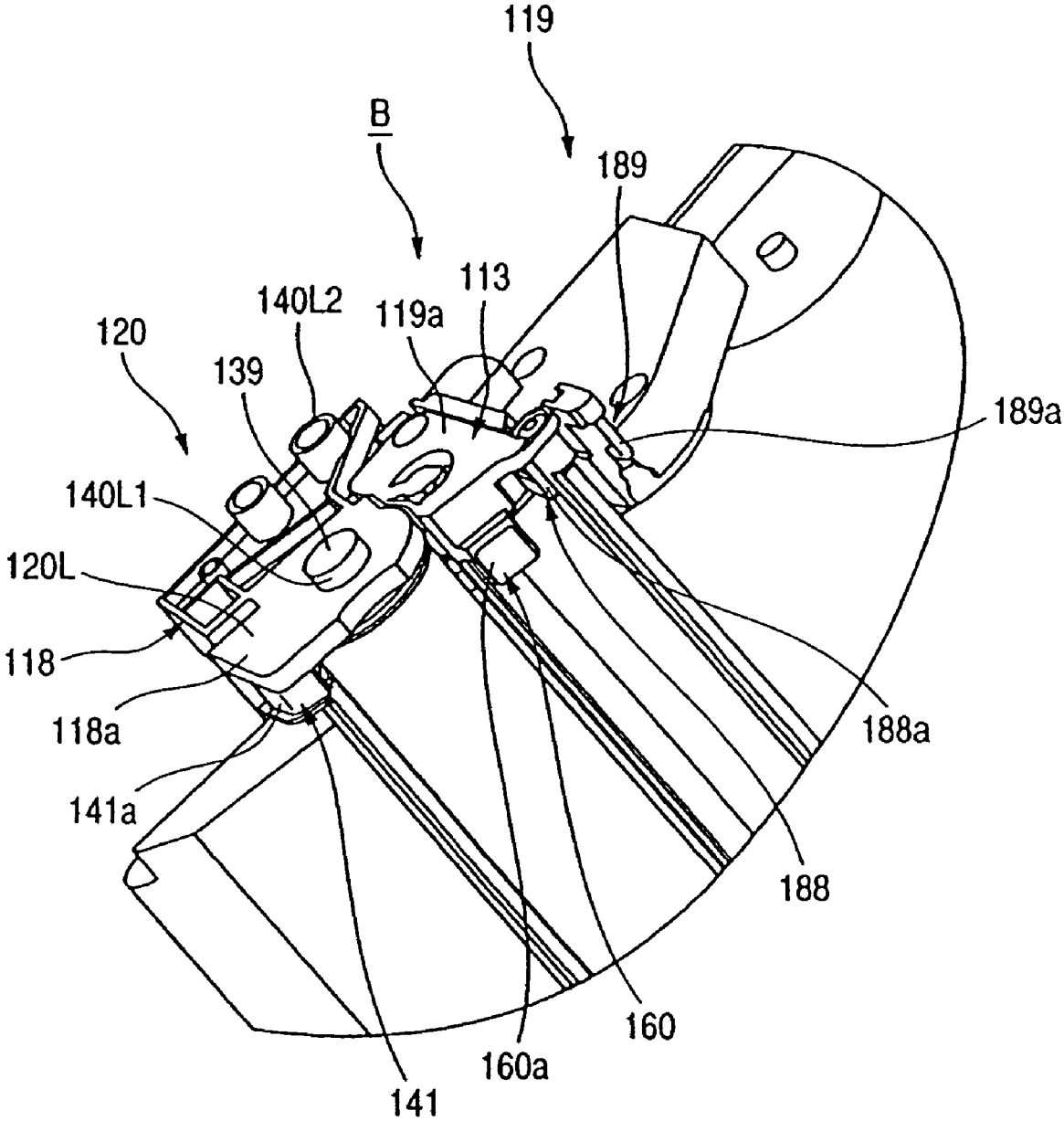
FIG. 8 is a perspective view showing the electrical contact of the process cartridge according to the embodiment of the present invention.

As shown in FIG. 8, the cartridge B has a charging input electrical contact member 141 and a developing input electrical contact member 160 as cartridge electrical contact members. These electrical contact members (141 and 160) are for applying voltages to the charging roller 108 and the developing roller 110, respectively. The cartridge B further has a first cartridge remaining amount detecting contact member 188 and a second cartridge remaining amount detecting contact member 189 as cartridge electrical contact members. These electrical contact members (188 and 189) are for applying a voltage to one of the first detecting electrode 190 and the second detecting electrode 191, and outputting a developer amount detection voltage from the other of the first detecting electrode 190 and the second detecting electrode 191 to the apparatus main body A.

In the present embodiment, the charging input electrical contact member 141 and the developing input electrical contact member 160 are constituted by metallic thin plates. On the other hand, the first cartridge remaining amount detecting contact member 188 and the second cartridge remaining amount detecting contact member 189 are constituted by metallic bars.

The charging input electrical contact member 141 is provided on the left end portion 120L of the drum unit 120 as viewed in the direction X in which the cartridge B is mounted, in a state in which the cartridge B has been mounted on the apparatus main body A. Also, the charging input electrical contact member 141 is provided so as to be exposed below the drum frame member 118 and forwardly in the direction X in which the cartridge B is mounted, in the state in which the cartridge B has been mounted on the apparatus main body A. The forward exposed portion which is a portion of this charging input electrical contact member 141 is a charging input contact 141*a*. The charging input contact 141*a* is provided more inside the cartridge B than a drum frame member side 118*a*.

Also, the developing input electrical contact member 160, the first cartridge remaining amount detecting contact member 188 and the second cartridge remaining amount detecting contact member 189 are provided on the left end portion 119*a* of the developing unit 119. Further, they are provided so as to be exposed from below the developing frame member 113 in the state in which the cartridge B has been mounted on the apparatus main body A. The downwardly exposed surface, which is a portion of the developing input electrical contact member 160, is a developing input electrical contact 160*a*. Also, a first cartridge remaining amount detecting contact 188*a* and a second cartridge remaining amount detecting contact 189*a* which are respective portions of the first cartridge remaining amount detecting contact member 188 and the second cartridge remaining amount detecting contact member 189 are exposed below them. The first cartridge remaining amount detecting contact 188*a* and the second cartridge remaining amount detecting contact 189*a* are provided along the lengthwise direction of the cartridge B (the axial direction of the photosensitive drum 107). The developing input electrical contact 160*a*, the first cartridge remaining amount detecting contact 188*a* and the second cartridge remaining amount detecting contact 189*a* are provided more inside the cartridge B than a developing unit side 119*a*.

The charging input electrical contact 141*a*, the developing input electrical contact 160*a*, the first cartridge remaining amount detecting contact 188*a* and the second cartridge remaining amount detecting contact 189*a* are provided in the named order from the downstream side to the upstream side with respect to the direction X in which the cartridge B is mounted. Also, the first cartridge remaining amount detecting contact 188*a*, the second cartridge remaining amount detecting contact 189*a* and the developing input electrical contact 160*a* are provided in the named order from the developing unit side 119*a* side to the inside of the cartridge B.

The charging input electrical contact 141*a*, the developing input electrical contact 160*a*, the first cartridge remaining amount detecting contact 188*a* and the second cartridge remaining amount detecting contact 189*a* are electrically connected to the charging roller 108, the developing roller 110, the first detecting electrode 190 and the second detecting electrode 191, respectively, in the interior of the cartridge B.

As shown in FIG. 6, the apparatus main body A is provided with a charging output electrical contact member 144 and a developing output electrical contact member 161 as main body electrical contact members for applying a charging voltage and a developing voltage, respectively. The charging output electrical contact member 144 and the developing output electrical contact member 161 are electrically connected to the charging input electrical contact 141*a* and the developing input electrical contact 160*a*, respectively, when the cartridge B is mounted on the apparatus main body A. Also, the apparatus main body A is provided with a first main body remaining amount detecting contact member 163 and a second main body remaining amount detecting contact member 164 as main body electrical contact members for applying a voltage to one of the first detecting electrode 190 and the second detecting electrode 191, and receiving a developer amount detection voltage from the other of the first detecting electrode 190 and the second detecting electrode 191. When the cartridge B is mounted, the first main body remaining amount detecting contact member 163 and the second main body remaining amount detecting contact member 164 are electrically connected to the cartridge remaining amount detecting contacts 188*a* and 189*a*, respectively. The charging output electrical contact member 144, the developing output electrical contact member 161, the first main body remaining amount detecting contact member 163 and the second main body remaining amount detecting contact member 164 are exposed to the cartridge mounting portion 130*a*.

Figure 9:
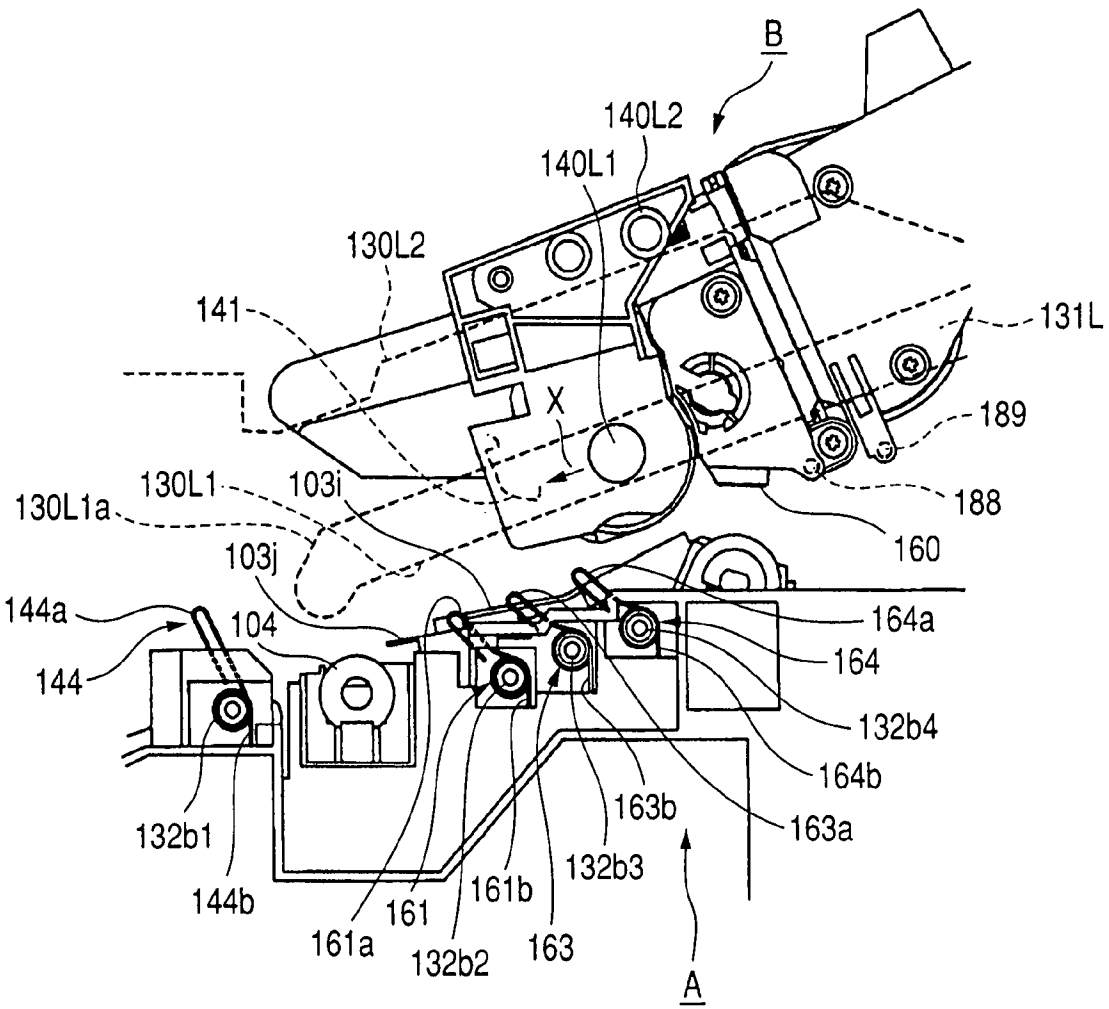
FIG. 9 is a schematic view for illustrating the electrical connection mode of a main body electrical contact and the cartridge electrical contact in the embodiment of the present invention.
Figure 10:
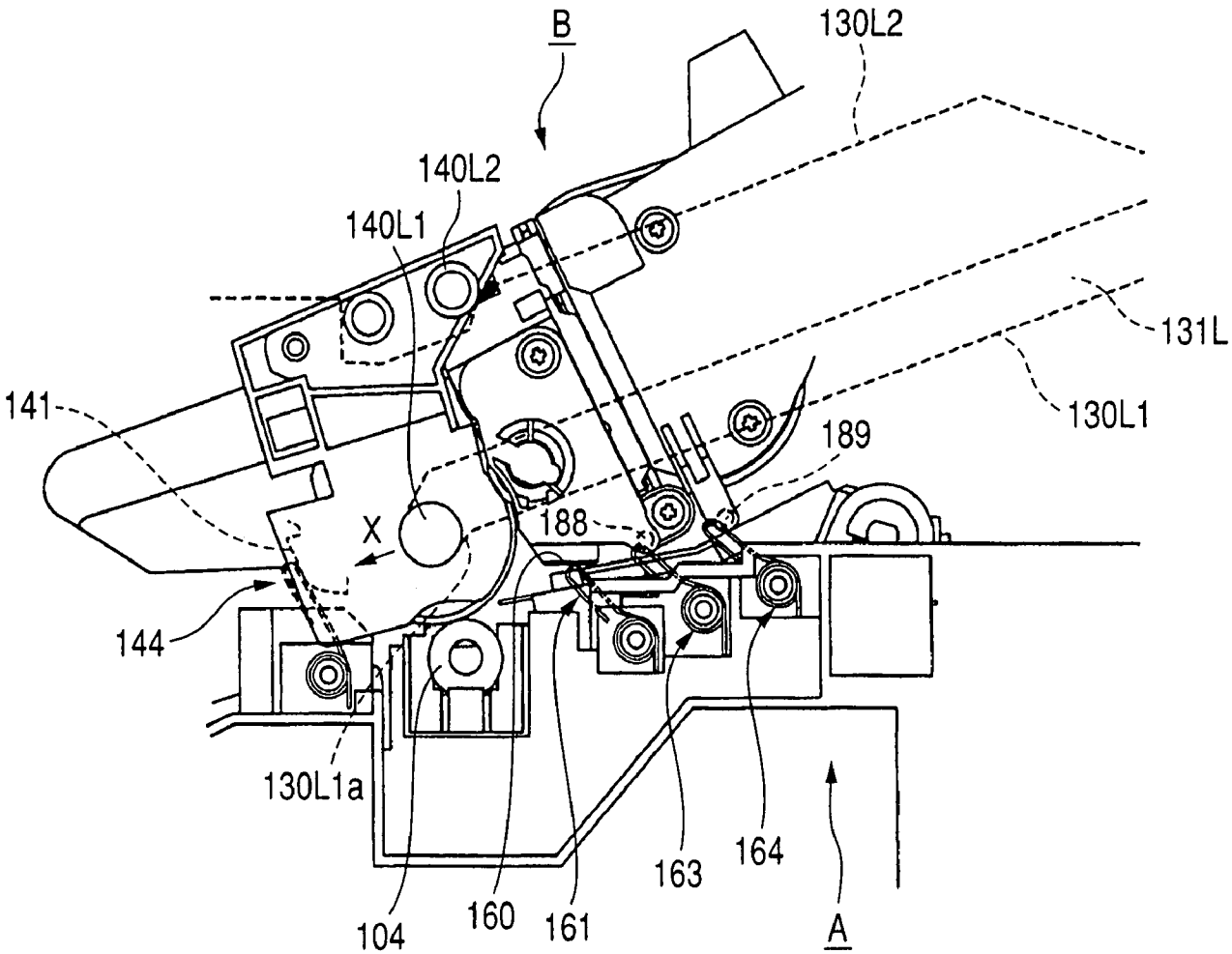
FIG. 10 is a schematic view for illustrating the electrical connection mode of the main body electrical contact and the cartridge electrical contact in the embodiment of the present invention.

A description will now be provided with reference to FIGS. 9 and 10. FIG. 9 shows a state in the course of mounting the cartridge B on the apparatus main body A. FIG. 10 shows a state in which the cartridge B has been mounted on the apparatus main body A. Each of the main body electrical contact members 144, 161, 163 and 164 is constituted by a torsion coil spring, which is a resilient member. These main body electrical contact members 144, 161, 163 and 164 are mounted on shafts 132*b*1, 132*b*2, 132*b*3 and 132*b*4, respectively, provided on the inner side plate 132 of the apparatus main body A. As a portion of each of the main body electrical contact members 144, 161, 163 and 164, one arm portion of the torsion coil spring, which is bent into a U-shape, is exposed to the cartridge mounting portion 130*a*. The exposed portions of the respective main body electrical contact members are the charging output electrical contact 144*a*, the developing output electrical contact 161*a*, the first main body remaining amount detecting contact 163*a* and the second main body remaining amount detecting contact 164*a*. The charging output electrical contact 144*a*, the developing output electrical contact 161*a*, the first main body remaining amount detecting contact 163*a* and the second main body remaining amount detecting contact 164*a* contact the respective cartridge electrical contacts 141*a*, 160*a*, 188*a* and 189*a* with suitable spring pressure. Thus, each main body electrical contact and each cartridge electrical contact each other.

As shown in FIG. 10, with respect to the main body electrical contacts 144*a*, 161*a*, 163*a* and 164*a*, the cartridge B is inserted in the direction of arrow X along the aforedescribed cartridge mounting means 130.

The other arm portions 144*b*, 161*b*, 163*b* and 164*b* of the respective main body electrical contact members 144, 161, 163 and 164 are connected to an electric circuit (not shown) in the interior of the apparatus main body.

The charging output electrical contact 144*a*, the developing output electrical contact 161*a*, the first main body remaining amount detecting contact 163*a* and the second main body remaining amount detecting contact 164*a* are provided in the named order from the downstream side to the upstream side with respect to the direction X in which the cartridge B is mounted. Also, the first main body remaining amount detecting contact 163*a*, the second main body remaining amount detecting contact 164*a* and the developing output electrical contact 161*a* are provided in the named order from the inner side plate 132 to the inside of the cartridge mounting portion 130*a*.

[5. Discharge Preventing Mechanism]

The discharge preventing mechanism of the image forming apparatus according to the present invention will now be described with reference to FIGS. 6 and 11 to 13.

The image forming apparatus 100 has an electrically grounded electrically conductive discharge preventing member 146. This discharge preventing member 146, when a charged foreign substance enters the interior of the apparatus main body A on which the cartridge B is not mounted, effects discharge between it and this foreign substance. Thereby, this discharge preventing member 146 prevents discharge from occurring between this foreign substance and the main body electrical contact.

The charged foreign substance refers to any other charged substance than the cartridge B to be mounted on the apparatus main body A. Typically, it is the charged operator's hand inserted into the apparatus main body A on which the cartridge B is not mounted, for the purpose of jam treatment or the maintenance or the like of the apparatus main body A.

The discharge preventing member 146 is made movable between a first position and a second position retracted from the first position. Here, the first position of the discharge preventing member 146 is located in the entry route of the cartridge B. Also, the second position of the discharge preventing member 146 is located outside the entry route of the cartridge B.

Also, there is provided an actuating member for moving the discharge preventing member 146 from the first position to the second position. This actuating member abuts against the cartridge B when the cartridge B is mounted in the apparatus main body A. Then, this actuating member actuates to move the discharge preventing member 146 from the first position to the second position. A description will hereinafter be provided in greater detail.

When the cartridge B is not mounted on the apparatus main body A, the discharge preventing member 146 protrudes through a slit 145*d* in the side plate 145 of the apparatus main body A and lies in the entry route of the cartridge B. The discharge preventing member 146 is disposed above and near the developing output electrical contact 161*a*, the first main body remaining amount detecting contact 163*a* and the second main body remaining amount detecting contact 164*a*. The slit 145*d* extends through the side plate 145 and is formed substantially horizontally. Correspondingly to the slit 145*d*, the inner side plate 132 is formed with a slit 132*c* fitting the slit 145*d*.

An actuating member abutting portion (hereinafter simply referred to as the "abutting portion") 147*d* is constructed on a discharge preventing member supporting member (hereinafter referred to as the "supporting member") 147 (FIG. 11) functioning as an actuating member. This abutting portion 147*d* protrudes through an aperture 145*e* in the side plate 145 when the cartridge B is not mounted on the apparatus main body A. The aperture 145*e* is formed at and through a location in the side plate 145 corresponding to a groove 131L. That is, the supporting member 147 is provided with the abutting portion 147*d* which is a portion abutting against the cartridge B. The abutting portion 147*d* protrudes into the groove 131L when the cartridge B is not mounted on the apparatus main body A.

Figure 11:
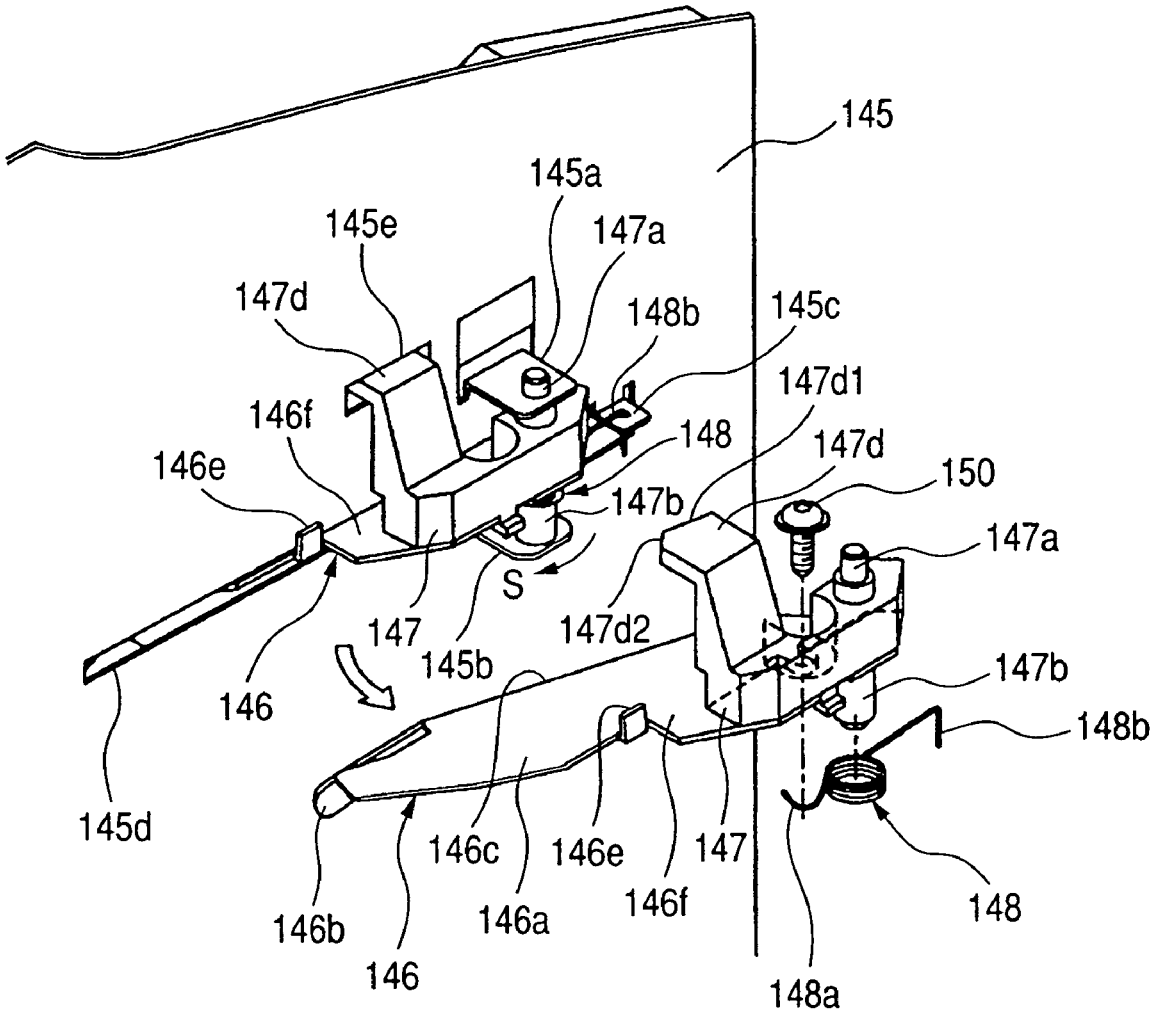
FIG. 11 is a perspective view of the vicinity of a discharge preventing member mounting portion for illustrating the construction of the discharge preventing member of the image forming apparatus according to the embodiment of the present invention.

FIG. 11 is a view of the apparatus main body A as it is seen from the outside of the side plate 145 (the opposite side of the cartridge mounting portion 130*a* with respect to the side plate 145 of FIG. 6) in order to illustrate the construction of the discharge preventing member 146. In FIG. 11, the discharge preventing member 146 and the supporting member 147 as they are detached from the side plate 145 are also shown in order to facilitate understanding.

The discharge preventing member 146 is constituted by a metallic plate. In the present embodiment, the major portion 146*a* of the discharge preventing member 146 is along a substantially horizontal plane in a state in which it is mounted on the image forming apparatus 100. The major portion 146*a* is provided for movement relative to the image forming apparatus 100. Also, an end surface 146*c* is provided on that side of the major portion 146*a* which is adjacent to the cartridge mounting portion 130*a*. Further, an arm portion 146*b* is provided near the downstream tip end of the end surface 146*c* with respect to the mounting direction of the cartridge B. This arm portion 146*b* is bent substantially vertically downwardly relative to the plane of the major portion 146*a*. Furthermore, this arm portion 146*b* is inclined toward the downstream side with respect to the mounting direction X of the cartridge B. Also, a restraining portion 146*e* is provided on that end surface of the major portion 146*a* which is opposite to the cartridge mounting portion 130*a*. The restraining portion 146*e* is substantially vertically upwardly formed in a state in which the discharge preventing member 146 is mounted on the image forming apparatus 100.

The discharge preventing member 146 is fixed to the supporting member 147 made of resin as an actuating member for actuating the discharge preventing member 146, by a screw 150. The supporting member 147 is always located outside the side plate 145. That is, the supporting member 147 is fixed to a holding portion 146*f* located on a side opposite to the cartridge mounting portion 130*a* with respect to the restraining portion 146*e*. The supporting member 147 is rotatably mounted on mounting portions 145*a* and 145*b* through substantially vertically protruding shaft portions 147*a* and 147*b*. The mounting portions 145*a* and 145*b* are outwardly protruded from the side plate 145.

A torsion coil spring 148 as a resilient acting member is attached to the shaft portion 147*b* extending below the supporting member 147. One arm portion 148*a* of the torsion coil spring 148 is hooked on a screw 150. The other arm portion 148*b* of the torsion coil spring 148 is inserted in an aperture in a spring attachment portion 145*c* provided on the side plate 145. Thereby, the supporting member 147 and the discharge preventing member 146 are biased in the direction of arrow S. That is, the discharge preventing member 146 is biased toward the interior of the cartridge mounting portion 130*a* (from the second position toward the first position). The restraining portion 146*e* of the discharge preventing member 146 abuts against the side plate 145. By doing so, the position of the discharge preventing member 146 is regulated. In this case, an abutting portion 147*d* made of resin and projected toward the cartridge mounting portion 130*a* side is provided integrally with the supporting member 147. Further, this abutting portion 147*d* protrudes from the aperture 145*e* of the side plate 145 to the inside of the apparatus main body A.

Also, the side plate 145 is connected to the grounded terminal (not shown) of the apparatus main body A. On the other hand, the discharge preventing member 146 is electrically connected to the side plate 145 through the torsion coil spring 148 and the screw 150. As the result, the discharge preventing member 146 is connected to the grounded terminal (electrically grounded).

The outer side of the side plate 145 is covered with an outer cover C (see FIG. 5). The attachment portions 145*a* and 145*b* are disposed between the side plate 145 and the outer cover C. By these attachment portions 145*a* and 145*b*, the discharge preventing member 146 is movably held.

Figure 12:
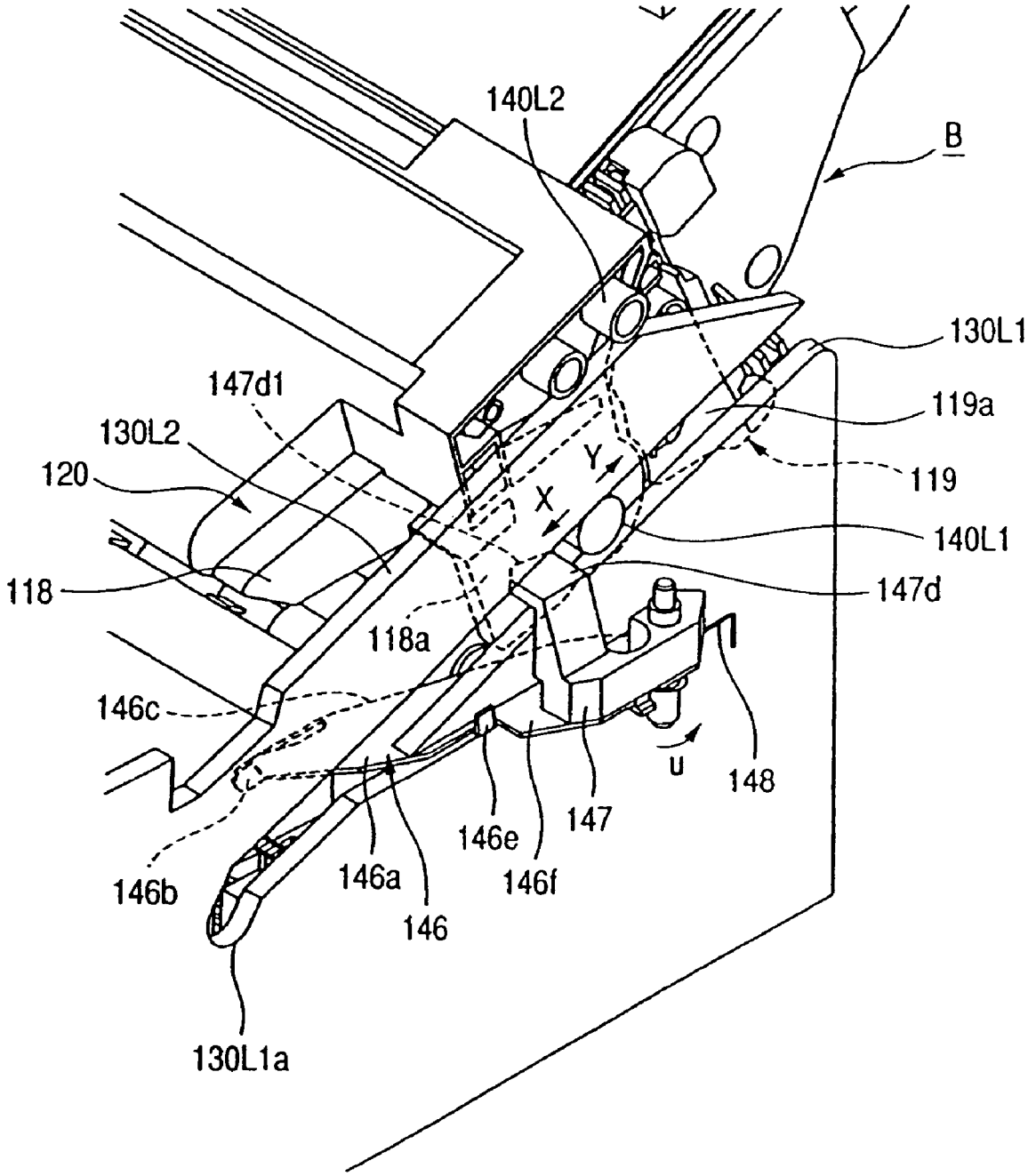
FIG. 12 is a perspective view of the vicinity of the discharge preventing member mounting portion for illustrating the operation of the discharge preventing member of the image forming apparatus according to the embodiment of the present invention.
Figure 13:
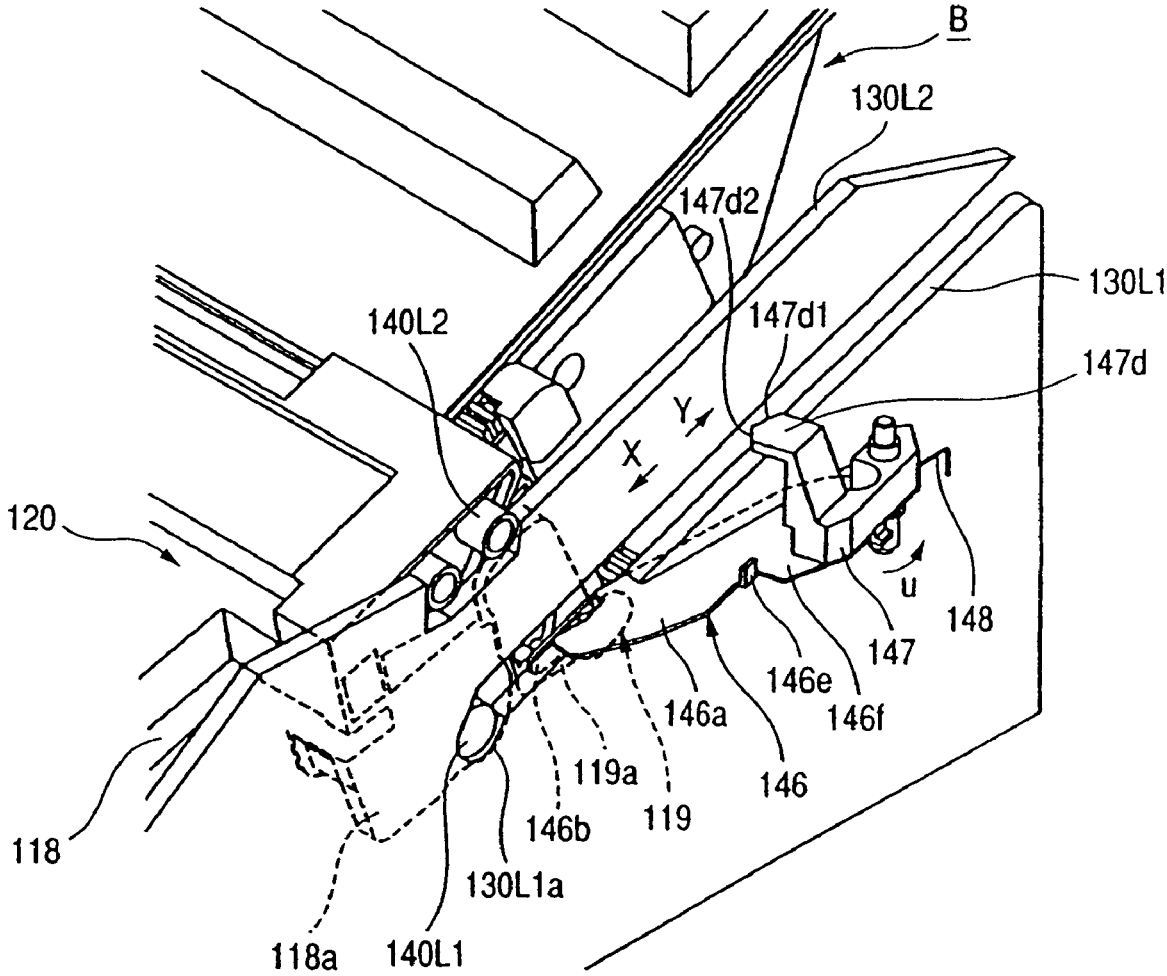
FIG. 13 is a perspective view of the vicinity of the discharge preventing member mounting portion for illustrating the operation of the discharge preventing member of the image forming apparatus according to the embodiment of the present invention.

FIGS. 12 and 13 illustrate the operation of the discharge preventing member 146. In order to facilitate understanding, the side plate 145 is omitted in FIGS. 12 and 13. FIG. 12 shows state in the course of mounting the cartridge B on the apparatus main body A. Also, FIG. 13 shows a state in which the cartridge B has been mounted on the apparatus main body A.

When as shown in FIG. 12 (see also FIG. 6), the cartridge B is not mounted on the apparatus main body A, the discharge preventing member 146 biased by the resilient force of the torsion coil spring 148 protrudes to the cartridge mounting portion 130*a*. In this state, the restraining portion 146*e* abuts against the side plate 145. As the result, the discharge preventing member 146 has its position regulated relative to the apparatus main body A. This position is the first position (initial position) of the discharge preventing member 146.

Further describing the operation of the member 146, the first position of the discharge preventing member 146 is in the entry route of the cartridge B. When the cartridge B is not mounted on the apparatus main body A, a charged foreign substance approaches the developing output electrical contact 161*a*, the first main body remaining amount detecting contact 163*a* and the second main body remaining amount detecting contact 164*a*. At that time, the charged foreign substance does not discharge to the developing output electrical contact 161*a* or the first main body remaining amount detecting contact 163*a* and the second main body remaining amount detecting contact 164*a*, but discharges to the discharge preventing member 146 lying in the first position.

In the present embodiment, at the first position, the discharge preventing member 146 substantially covers the developing output electrical contact 161*a*, the first main body remaining amount detecting contact 163*a* and the second main body remaining amount detecting contact 164*a* from above them. By this disposition, the discharge preventing member can be reliably prevented from discharging to the main body electrical contacts.

Next, the cartridge B is inserted into the apparatus main body A in the direction of arrow X. Thereupon, the first left cartridge guide 140L1 as the cartridge abutting portion abuts against the abutting portion 147*d* of the supporting member 147. Thereby, the first left cartridge guide 140L1 rotates the supporting member 147 and the discharge preventing member 146 in the direction of arrow U against the biasing force of the torsion coil spring 148. That is, the first left cartridge guide 140L1 retracts the supporting member 147 and the discharge preventing member 146 from the cartridge mounting portion 130*a*. Further, in other words, the supporting member 147 and the discharge preventing member 146 are moved from the first position to the second position against the biasing force of the torsion coil spring 148.

When the cartridge B is further inserted, the side 118*a* of the drum frame member 118 contacts with the end surface 146*c* of the discharge preventing member 146. Thereafter, the first left cartridge guide 140L1 passes the location at which the abutting portion 147*d* is located. Here, the side 118*a* and the portion from the end surface 146*c* to the arm portion 146*b* of the discharge preventing member 146 are in contact with each other. Therefore, the discharge preventing member 146 is held at a position to which it has been rotated in the direction of arrow U.

In a state in which as shown in FIG. 13, the cartridge B has been completely mounted on the apparatus main body A, the arm portion 146*b* of the discharge preventing member 146 and the side 119*a* of the developing unit 119 are in contact with each other. The discharge preventing member 146 is regulated at a position retracted from the cartridge mounting portion 130*a*. That is, the discharge preventing member 146 is held outside the entry route of the cartridge B. This position is the second position (retracted position) of the discharge preventing member 146.

Also, when the cartridge B is to be taken out of the apparatus main body A, the discharge preventing member 146 is returned to the initial position by an operation converse to what has been described above.

In the present embodiment, on the tip end of the abutting portion 147*d* which protrudes to the cartridge mounting portion 130*a* side, a convex portion is provided toward the cartridge mounting portion 130*a*. The convex portion has a first inclined surface 147*d*1 and a second inclined surface 147*d*2. The first inclined surface 147*d*1 is formed on the upstream side with respect to the mounting direction X of the cartridge B. Also, the second inclined surface 147*d*2 is formed on the downstream side with respect to the mounting direction X of the cartridge B. When the cartridge B is to be mounted on the apparatus main body A, the first left cartridge guide 140L1 pushes the first inclined surface 147*d*1. Thereby, the discharge preventing member 146 is moved to the second position.

When as described above, a charged foreign substance has entered the interior of the apparatus main body A on which the cartridge B is not mounted, the discharge preventing member 146 prevents the discharge of static electricity from occurring between the aforementioned foreign substance and the main body electrical contacts 161*a*, 163*a*, 164*a*. The discharge preventing member 146 is formed of an electrically conductive material electrically connected to the ground. The discharge preventing member 146 is movable between the first position located in the entry route of the cartridge B and the second position retracted from the first position and located outside the entry route. Also, the supporting member 147 as the actuating member moves the discharge preventing member 146 from the first position to the second position. The supporting member 147 abuts against the cartridge B when the cartridge B is mounted in the apparatus main body A. Thereby, the supporting member 147 is actuated. Then, the supporting member 147 moves the discharge preventing member 146 from the first position to the second position.

There is a case where in order to perform jam treatment or the like, the operator puts his hand near the developing output electrical contact 161*a*, the first main body remaining amount detecting contact 163*a* and the second main body remaining amount detecting contact 164*a* in the apparatus main body A. Even if in such case, the operator's hand is charged, discharge occurs to the discharge preventing member 146. Therefore, electrostatic noise is not applied to the main body electrical contacts of the apparatus main body A. Thereby, the destruction of the elements on the electric circuit can be prevented. Also, the developing output electrical contact 161*a*, the first main body remaining amount detecting contact 163*a* and the second main body remaining amount detecting contact 164*a* are difficult to touch inadvertently owing to the discharge preventing member 146. Therefore, man's sweat or grease or the like in the main body can be prevented from adhering to the main body electrical contacts to thereby cause faulty conduction. Thereby, the reliability of the electrical connection between the cartridge electrical contacts 160*a*, 188*a*, 189*a* and the main body electrical contacts 161*a*, 163*a*, 164*a* can be improved.

Also, in the present embodiment, the supporting member 147 has an abutting portion 147*d* abutting against the first left cartridge guide 140L1. This abutting portion 147*d* is located at a position at which it can abut against the aforementioned cartridge abutting portion when the discharge preventing member 146 is in the first position. Accordingly, the supporting member 147 abuts against the first left cartridge guide 140L1 when the cartridge B is mounted on the apparatus main body A. The supporting member 147 is then moved. Thereby, the supporting member 147 moves the discharge preventing member 146 from the first position to the second position. Further, there is provided a torsion coil spring 148 as a resilient acting member for causing a resilient force to act on the discharge preventing member 146. When the abutting portion 147*d* abuts against the first left cartridge guide 140L1 as the cartridge abutting portion, the supporting member 147 moves the discharge preventing member 146 from the first position to the second position against the resilient force of the torsion coil spring 148. That is, in operative association with the mounting operation of mounting the cartridge B in the apparatus main body A, the discharge preventing member 146 is moved from the first position to the second position. Also, in operative association with the taking-out operation of taking the cartridge B out of the apparatus main body A, the discharge preventing member 146 is moved from the second position to the first position.

Thus, the operator need not perform any special operation to move the discharge preventing member. Also, as described above, in the present embodiment, when the cartridge B is not mounted on the apparatus main body A, the abutting portion 147*d* of the supporting member 147, which is a portion abutting against the cartridge B protrudes into the groove 131L. Then, the first left cartridge guide 140L1 abuts against the abutting portion 147*d*. As the result, the abutting portion 147*d* is moved. Thereby, it never happens that the discharge preventing member 146 formed by an electrically conductive member is moved directly by the cartridge B. Thereby, the possibility of the cartridge B being damaged can be reduced. Also, the disposition and shape of the abutting portion 147*d* can be more freely set, as compared with those of the cartridge B. Accordingly, it is easy to adjust the retraction timing of the discharge preventing member 146 from the first position to the second position, and the return timing thereof from the second position to the first position. Further, the first left cartridge guide 140L1, which is a mounting guide member, functions as a cartridge abutting portion for actuating the supporting member 147. Thus, it is unnecessary to provide any special member on the cartridge B. Thereby, the size of the cartridge B can be minimized.

Further, as shown in FIG. 6, the apparatus main body A has an upper transfer guide 103*i* and a lower transfer guide 103*j* as conveying guides for the recording medium 102. The upper transfer guide 103*i* and the lower transfer guide 103*j* are provided on this side of the transfer roller 104 with respect to the mounting direction X of the cartridge B. In the present embodiment, each of the upper transfer guide 103*i* and the lower transfer guide 103*j* is formed by a metallic plate. The upper transfer guide 103*i* and the lower transfer guide 103*j* are ground to the apparatus main body A (are electrically grounded). The developing output electrical contact 161*a*, the first main body remaining amount detecting contact 163*a* and the second main body remaining amount detecting contact 164*a* of the apparatus main body A are disposed near the sides of the upper transfer guide 103*i* and the lower transfer guide 103*j*.

Thereby, when the operator inserts his charged hand or the like into the vicinity of the developing output electrical contact 161*a*, the first main body remaining amount detecting contact 163*a* and the second main body remaining amount detecting contact 164*a*, discharge occurs to the upper transfer guide 103*j* or the lower transfer guide 103*j*. Therefore, the discharge to the main body electrical contacts can be further prevented. Also, together with the discharge preventing effect of the discharge preventing member 146, the discharge preventing effect is more consolidated. Also, the discharge preventing member 146 can be reduced in size and thus, the apparatus can be downsized.

Figure 14:
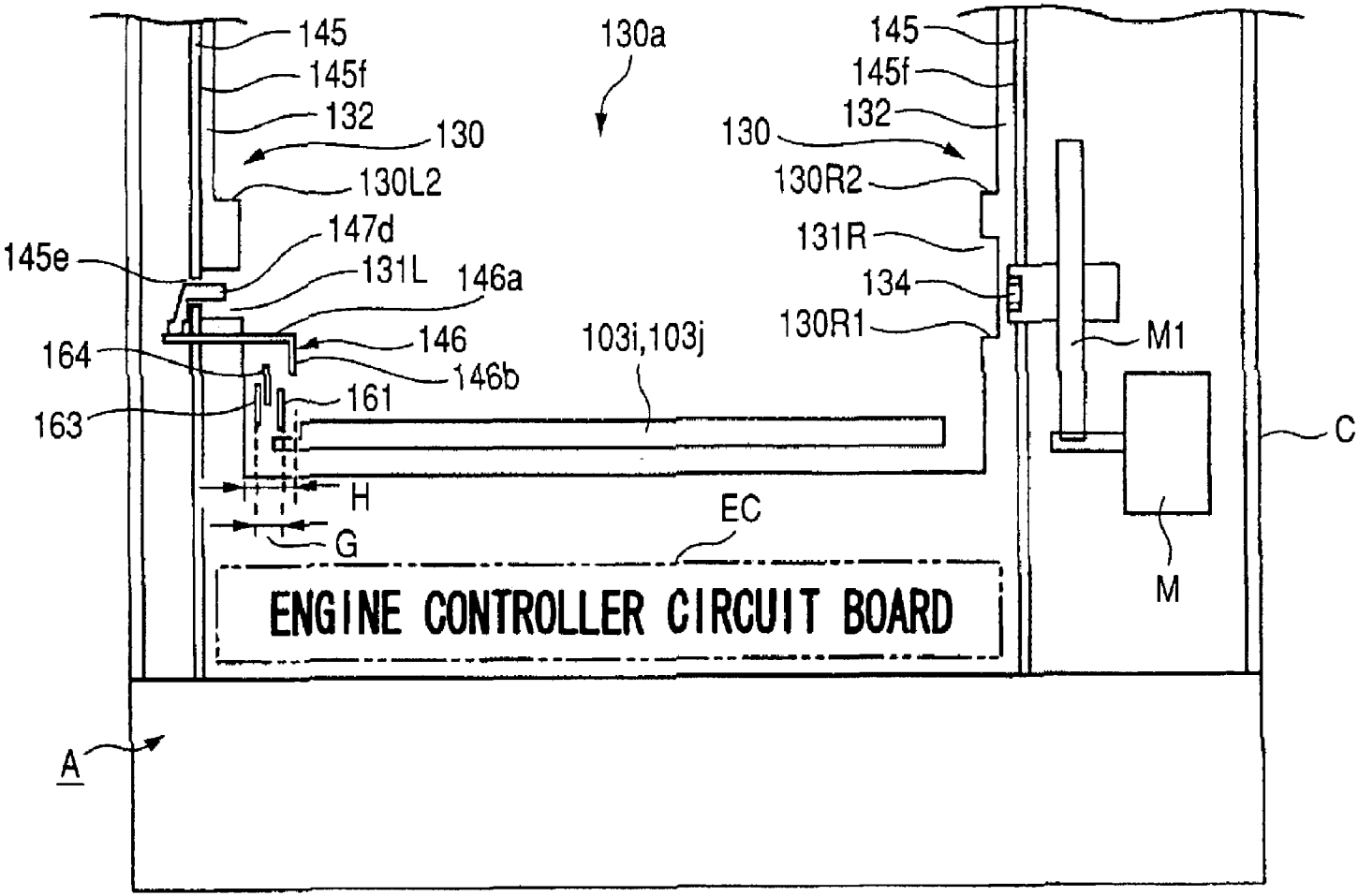
FIG. 14 is a front view of the interior of the image forming apparatus according to the embodiment of the present invention.

Reference is now made to FIG. 14 to further describe the arrangement mode of the discharge preventing member 146 and the upper transfer guide 103*i*. FIG. 14 is an interior front view of the apparatus main body A as it is seen from this side (i.e., the side on which the cartridge B is mounted) toward the mounting direction X.

A circuit board EC (FIG. 15) is disposed on the bottom surface of the apparatus main body A, i.e., below the cartridge mounting portion 130*a*. Also, a motor M and a drive gear train (driving force transmitting means) M1 for transmitting the driving force of the motor M to the coupling 134 or the like are disposed on one end side of the mounting portion 130*a* which is the outside of the inner side 145*f* of the side plate 145.

Also, the developing output electrical contact 161*a*, the first main body remaining amount detecting contact 163*a* and the second main body remaining amount detecting contact 164*a* are provided on the other end side of the cartridge mounting portion 130*a*. Also, the discharge preventing member 146 is provided on the other end side. The discharge preventing member 146, in the first position when the cartridge B is not mounted on the apparatus main body A, protrudes into the insertion route of the cartridge B. Further, at that time, the abutting portion 147*d* protrudes into the groove 131L.

When the discharge preventing member 146 is in the first position, the main body electrical contacts (the developing output electrical contact 161*a*, the first main body remaining amount detecting contact 163*a* and the second main body remaining amount detecting contact 164*a*) are disposed in the area H of the discharge preventing member 146 in a direction intersecting (here, substantially orthogonal to) the conveying direction Z of the recording medium 102. In other words, an area G in which the main body electrical contacts are disposed is disposed in the area H of the discharge preventing member 146. Thereby, when the operator's charged hand or the like is inserted into the vicinity of the developing output electrical contact 161*a*, the first main body remaining amount detecting contact 163*a* and the second main body remaining amount detecting contact 164*a*, it can be made easier for discharge to occur to the discharge preventing member 146.

Particularly, in the present embodiment, the cartridge mounting portion 130*a* is upwardly opened when the cartridge B is not mounted on the apparatus main body A. Accordingly, the operator's charged hand or the like usually enters from above substantially in the same direction as the mounting direction X of the cartridge B. Therefore, in the present embodiment, when the discharge preventing member 146 is in the first position, the discharge preventing member 146 is disposed above at least a portion of the main body electrical contacts (the developing output electrical contact 161*a*, the first main body remaining amount detecting contact 163*a* and the second main body remaining amount detecting contact 164*a* which are the main body electrical contacts). In the present embodiment, the discharge preventing member 146 substantially covers these main body electrical contacts 161*a*, 163*a* and 164*a* from above them. That is, when in a state in which the cartridge B is not mounted on the apparatus main body A, the operator looks at the apparatus main body A in the direction in which the cartridge B is mounted, the main body electrical contacts 161*a*, 163*a* and 164*a* become the rear of the major portion 146*a* of the discharge preventing member 146.

Thus, even when the operator inserts his charged hand or the like into the apparatus main body A in the direction in which the cartridge B is mounted, the hand comes near the discharge preventing member 146 before it comes near the main body electrical contacts 161*a*, 163*a* and 164*a*. Accordingly, it becomes easier for discharge to occur from the operator's hand or the like to the discharge preventing member 146. Accordingly, discharge to the main body electrical contacts 161*a*, 163*a* and 164*a* can be prevented more reliably. Further, it becomes difficult for the operator to inadvertently touch the main body electrical contacts 161*a*, 163*a* and 164*a*.

In the present embodiment, at least a portion of the upper transfer guide 103*i* and the lower transfer guide 103*j*, which are the conveying guides, is disposed in the area H wherein the discharge preventing member 146 is disposed, in a direction intersecting (here, substantially orthogonal to) the conveying direction Z of the recording medium 102.

Thus, when the operator's charged hand or the like has come near the main body electrical contacts 161*a*, 163*a* and 164*a* from a direction (arrow P) intersecting the mounting direction X of the cartridge (the conveying direction of the recording medium 102), the charged hand or the like comes near from the direction in which the upper transfer guide 103*i* and the lower transfer guide 103*j* are provided. Therefore, it is easier for discharge to occur to the upper transfer guide 103*i* and the lower transfer guide 103*j*. Also, the main body electrical contacts 161*a*, 163*a* and 164*a* are disposed in the area H of the discharge preventing member 146. Accordingly, among the discharge preventing member 146, the upper transfer guide 103*i* and the lower transfer guide 103*j*, it becomes easier for discharge to occur to the discharge preventing member 146 or the upper transfer guide 103*i*. Thereby, discharge to the main body electrical contacts 161*a*, 163*a* and 164*a* can be prevented more effectively.

Further, in the present embodiment, the discharge preventing member 146 is provided with the arm portion 146*b* so as to be brought close by the upper transfer guide 103*i*, besides the major portion 146*a*.

Thereby, it becomes easy for discharge to occur to this arm portion 146*b* when a charged foreign substance has come near the main body electrical contacts 161*a*, 163*a* and 164*a* from the direction (arrow P) intersecting the mounting direction X of the cartridge B (the conveying direction of the recording medium 102). Also, if a portion of the upper transfer guide 103*i* or the lower transfer guide 103*j* is disposed in the area G, it becomes easier for discharge to occur to the discharge preventing member 146 (arm portion 146*b*) or the upper transfer guide 103*i* and the lower transfer guide 103*j* between the discharge preventing member 146 (arm portion 146*b*) and the upper transfer guide 103*i*, and the lower transfer guide 103*j*. Thereby, the discharge to the main body electrical contacts 161*a*, 163*a* and 164*a* can be prevented more effectively.

Figure 20:
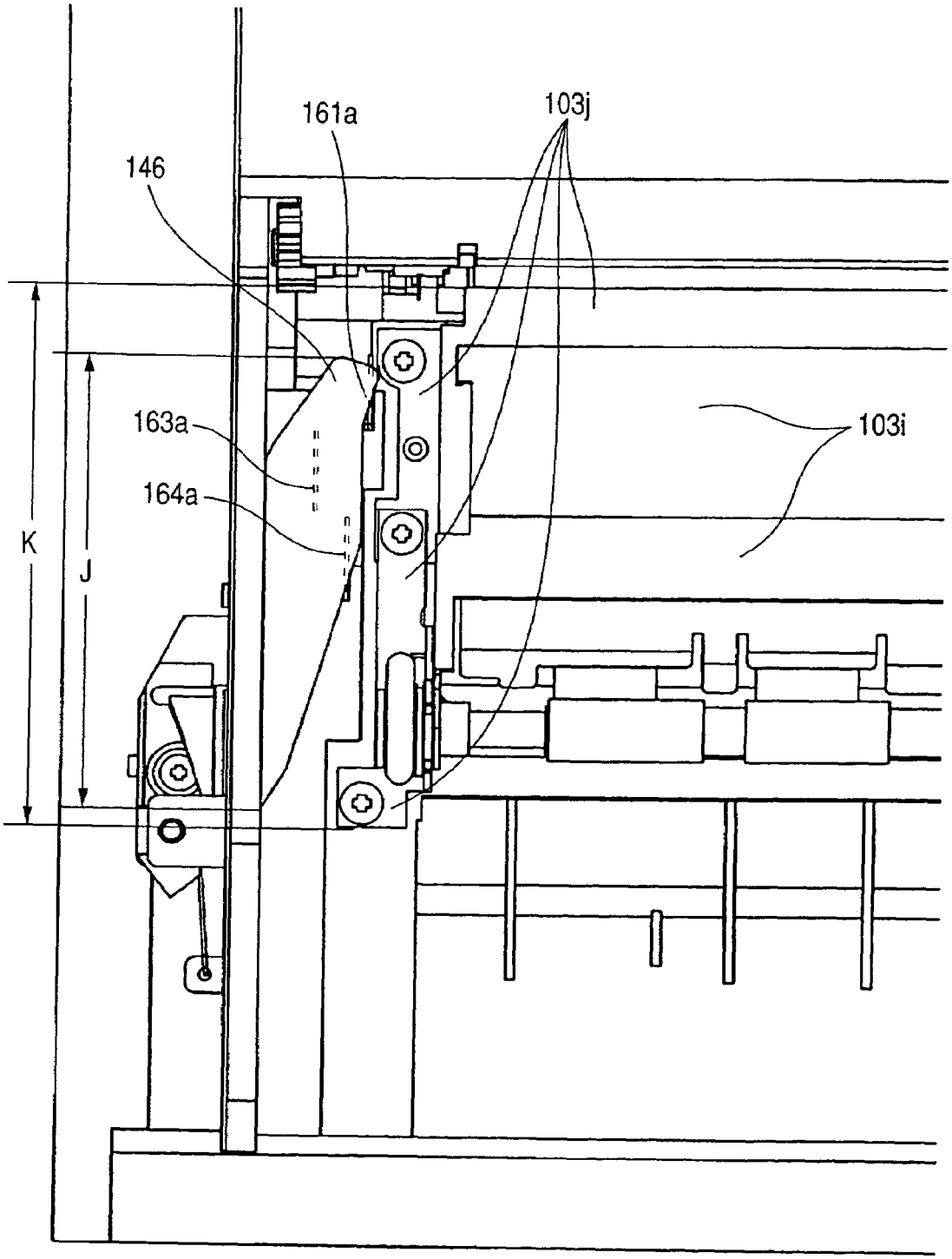
FIG. 20 is a view for illustrating the positional relations among the discharge preventing member, the upper transfer guide, the lower transfer guide and the main body electrical contact of the image forming apparatus according to another embodiment of the present invention.

FIG. 20 is a view of the mounting portion 130*a* when in the present embodiment the discharge preventing member 146 is located in the first position as it is seen from above it. When as shown in FIG. 20, the discharge preventing member 146 is located in the first position, the first main body remaining amount detecting contact 163*a* and the second main body remaining amount detecting contact 164*a* are located in an area J wherein the discharge preventing member 146 is located, in the conveying direction Z of the recording medium 102. Here, the area J is the area between the most upstream portion and the most downstream portion of the discharge preventing member 146 with respect to the aforementioned conveying direction. Further, at least a portion of the developing output electrical contact 161*a* is disposed in the area J of the discharge preventing member 146. In other words, when the discharge preventing member 146 is located in the first position, at least a portion of each main body electrical contact is disposed in the area J of the discharge preventing member 146 in the conveying direction Z of the recording medium 102. Thereby, when a charged foreign substance has entered the apparatus main body A, it is easy for discharge to occur between this foreign substance and the discharge preventing member 146. Accordingly, the electric circuit or the main body electrical contacts are effectively protected. Further, in the conveying direction Z of the recording medium 102, the respective main body electrical contacts (the first main body remaining amount detecting contact 163*a*, the second main body remaining amount detecting contact 164*a* and the developing output electrical contact 161*a*) are located in an area K wherein the upper transfer guide 103*i* and the lower transfer guide 103*j* are located. Here, the area K is the area between the most upstream portion and the most downstream portion of the upper transfer guide 103*i* and the lower transfer guide 103*j* with respect to the aforementioned conveying direction. Thereby, when a charged foreign substance has entered the apparatus main body, it is easy for discharge to occur between this foreign substance and the transfer guides (103*i*, 103*j*). Accordingly, the electric circuit or the main body electrical contacts are protected more effectively.

As a specific example, as shown in FIG. 6, in the present embodiment, the distance between the arm portion 146*b* of the discharge preventing member 146 and the downstream side end surface 103*i*1 of the upper transfer guide 103*i*, and the distance between the end surface 146*c* of the discharge preventing member 146 and the upstream side end surface

103*i*2 of the upper transfer guide 103*i* are 10 mm 15 mm. Here, the thickness of the operator's fingers is a diameter of about 15 mm. When the charged fingers come near the developing output electrical contact 161*a*, the first main body remaining amount detecting contact 163*a* and the second main body remaining amount detecting contact 164*a* from the direction of arrow P, discharge occurs to the discharge preventing member 146 or the upper transfer guide 103*i*. The present embodiment is designed such that when fingers come very close to the discharge preventing member 146 (the arm portion 146*b*, the end surface 146*c*), the distance between the fingers and the developing output electrical contact 161*a*, the first main body remaining amount detecting contact 163*a*, the second main body remaining amount detecting contact 164*a* becomes about 10 mm. Thus, discharge can be prevented from occurring to the developing output electrical contact 161*a*, the first main body remaining amount detecting contact 163*a*, and the second main body remaining amount detecting contact 164*a*.

[6. Circuit Board EC (Electric Circuit E)]

Figure 15:
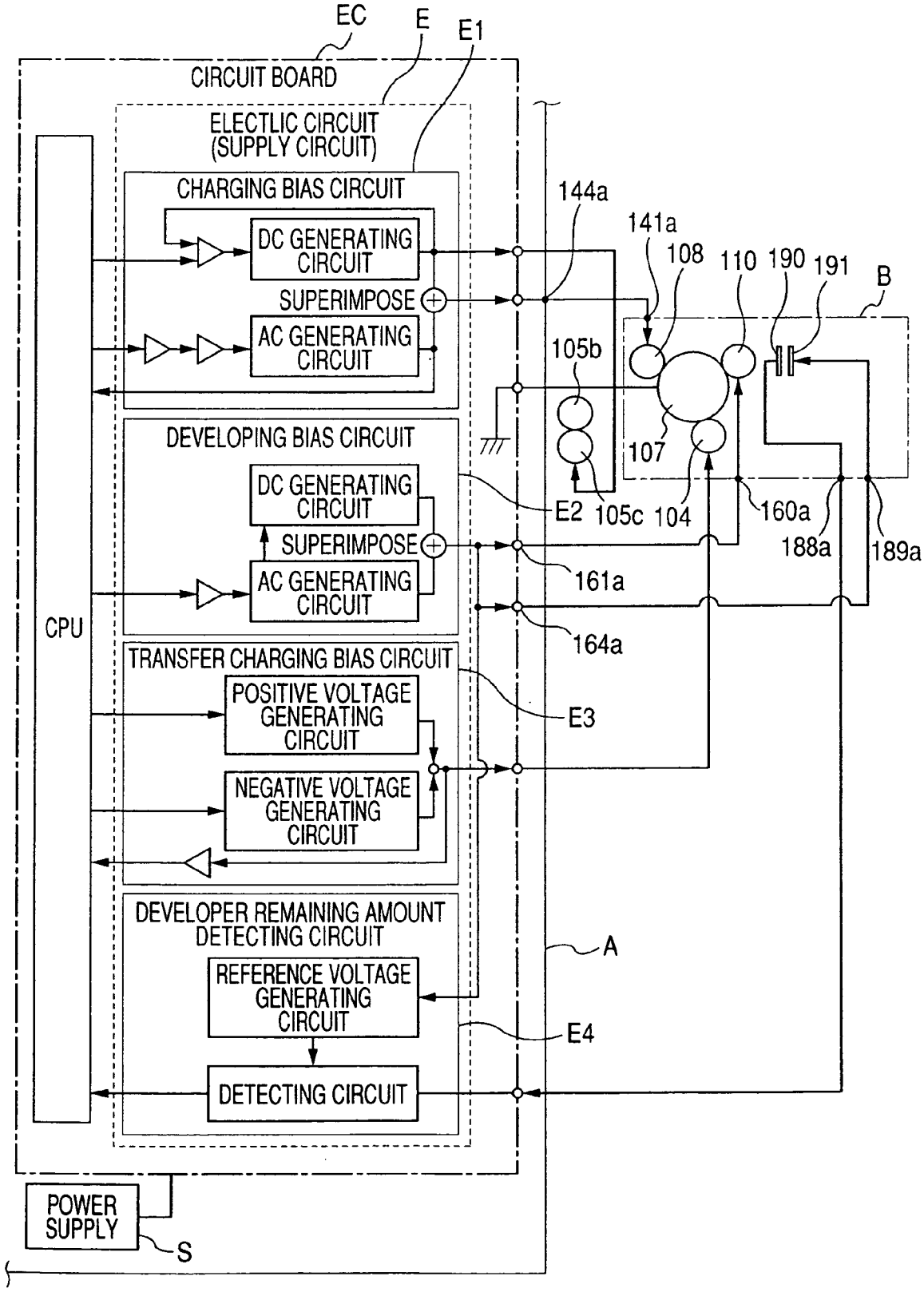
FIG. 15 is a schematic block diagram for illustrating the construction of the engine controller circuit board of the image forming apparatus according to the embodiment of the present invention.

Reference is now made to FIG. 15 to describe a circuit board EC mounted on the apparatus main body A. The circuit board EC is mounted below the cartridge mounting portion 130*a*. The circuit board EC has a CPU 200 and an electric circuit E (supply circuit).

A power supply S is connected to the circuit board EC, i.e., to the electric circuit E. The electric circuit E is comprised of a charging bias circuit E1, a developing bias circuit E2, a transfer charging bias circuit E3, and a developer remaining amount detecting circuit E4.

The charging bias circuit E1 generates a negative DC voltage and an AC voltage. It applies to the charging roller 108 a voltage comprising the aforementioned voltages superimposed upon each other. The charging roller 108 receives this voltage and charges the photosensitive drum 107. The charging bias circuit E1 also applies a negative DC voltage to the fixing roller 105*b* through a drive roller 105*c*.

Also, the developing bias circuit E2 generates a negative DC voltage and an AC voltage. It applies to the developing roller 110 and the second detecting electrode 191 a voltage comprising the aforementioned voltages superimposed upon each other. The developing roller 110 receives this voltage and develops an electrostatic latent image with a developer.

Also, the transfer charging bias circuit E3 generates a positive or negative DC voltage. It applies the positive or negative voltage to the transfer roller 104.

Further, the first detecting electrode 190 is connected to the detecting circuit of the developer remaining amount detecting circuit E4, and an output voltage (developer amount detection voltage), when the voltage has been applied to the second detecting electrode 191 and the developing roller 110, is inputted thereto. Also, a reference voltage generating circuit generates a reference voltage for detecting a developer remaining amount, by the use of an electric current applied from the developing bias circuit E2. The detecting circuit outputs the difference between the reference voltage and the developer amount detection voltage as the detected value of the developer remaining amount to the CPU. The information of the thus detected remaining amount of the developer is reported to the user by a display portion (not shown) provided in the image forming apparatus main body A.

As described above, the voltage from the power supply S is supplied to the charging roller 108 through the charging bias circuit E1. The voltage from the power supply S is also supplied to the fixing roller 105*b* and the drive roller 105*c* through the charging bias circuit E1. Further, the voltage from the power supply S is supplied to the developing roller 110 and the second detecting electrode 191 through the developing bias circuit E2. Also, the voltage from the power supply S is supplied to the transfer roller 104 through the transfer charging bias circuit E3.

These circuits are controlled to be turned ON and OFF by instructions from the CPU provided on the circuit board EC.

Thus, in the present embodiment, the following effects can be achieved.

(1) When the cartridge B is not mounted on the apparatus main body A, the discharge preventing member 146 is located in the first position. At that time, in order to perform jam treatment or the like, the operator inserts his hand into the vicinity of the developing output electrical contact 161*a*, the first main body remaining amount detecting contact 163*a* and the second main body remaining amount detecting contact 164*a* in the apparatus main body A. In this case, even when the operator's hand (body) is charged, discharge occurs to the discharge preventing member 146. Therefore, it never happens that electrostatic noise is applied to the electrical contacts of the apparatus main body A. Thereby, the destruction of electrical elements provided in the electric circuit can be prevented. Also, it is difficult for the developing output electrical contact 161*a*, the first main body remaining amount detecting contact 163*a* and the second main body remaining amount detecting contact 164*a* to be inadvertently touched, owing to the discharge preventing member 146. Therefore, man's sweat or grease or the like in the main body can be prevented from adhering to the main body electrical contacts to thereby cause faulty conduction. Thereby, the reliability of the electrical connection between the cartridge electrical contacts 160*a*, 188*a*, 189*a* and the main body electrical contacts 161*a*, 163*a*, 164*a* can be improved.

In the present embodiment, the discharge preventing member 146 covers the developing output electrical contact 161*a*, the first main body remaining amount detecting contact 163*a* and the second main body remaining amount detecting contact 164*a*. In the construction of the present embodiment, the developing output electrical contact 161*a*, the first main body remaining amount detecting contact 163*a* and the second main body remaining amount detecting contact 164*a* are upstream of the charging output electrical contact 144*a* with respect to the mounting direction of the cartridge B. Therefore, during jam treatment or the like, it is easy for the operator's hand to have access to the first main body remaining amount detecting contact 163*a* and the second main body remaining amount detecting contact 164*a*, and it is difficult for the operator's hand to easily have access to the charging output electrical contact 144*a*. On the other hand, the present invention can likewise be applied to the charging output electrical contact 144*a*, such as providing a single member or a discrete discharge preventing member so as to be located, for example, in the upper portion of an area in which the charging output electrical contact 144*a* is provided, in conformity with the disposition mode of the charging output electrical contact 144*a*. Thereby, a further effect can be obtained in the prevention of the damaging of the electric circuit of the apparatus main body A, and an improvement in the reliability of the electrical connection between the main body electrical contacts and the cartridge electrical contacts.

(2) Further, when in a state in which the cartridge B is not mounted on the apparatus main body A, the operator sees in the mounting direction in which the cartridge B is mounted on the apparatus main body, the developing output electrical contact 161*a*, the first main body remaining amount detecting contact 163*a* and the second main body remaining amount detecting contact 164*a* positioned to the rear of the discharge preventing member 146. Thereby, it becomes easier for discharge to occur to the discharge preventing member 146, and the discharge to these main body electrical contacts 161*a*, 163*a* and 164*a* can be prevented more reliably. Furthermore, it becomes difficult for the operator to inadvertently touch the main body electrical contacts 161*a*, 163*a* and 164*a*.

(3) The movement of the discharge preventing member is operatively associated with the mounting and dismounting operation of the cartridge. Thereby, the operator need not perform any special operation to move the discharge preventing member.

(4) The abutting portion 147*d* of the supporting member 147 is moved by the first left cartridge guide 140L1, which is a cartridge abutting portion, to thereby move the discharge preventing member 146 from the first position to the second position. Thus, it never happens that the discharge preventing member 146 formed by an electrically conductive member is moved directly by the cartridge B. As the result, the possibility of the cartridge B being damaged can be reduced. Also, the disposition and shape of the abutting portion 147*d* can be more freely set, as compared with those of the cartridge B. Accordingly, it is easy to adjust the retraction timing of the discharge preventing member 146 from the first position to the second position, and the return timing thereof from the second position to the first position.

(5) The first left cartridge guide 140L1 functions as a cartridge abutting portion for actuating the supporting member 147. Thus, it is unnecessary to provide any special member on the cartridge B. Thereby, the number of parts of the cartridge B can be minimized.

(6) Further, the developing output electrical contact 161*a*, the first main body remaining amount detecting contact 163*a* and the second main body remaining amount detecting contact 164*a* are disposed near the sides of the upper transfer guide 103*i* and the lower transfer guide 103*j*. Therefore, when the operator inserts his charged hand (foreign substance) into the vicinity of the developing output electrical contact 161*a*, the first main body remaining amount detecting contact 163*a* and the second main body remaining amount detecting contact 164*a*, discharge occurs to one of the upper transfer guide 103*i*, the lower transfer guide 103*j* and the discharge preventing member 146. Thereby, together with the discharge preventing effect by the above-described discharge preventing member 146, the protection of the aforementioned contacts can be achieved more reliably. Also, by utilizing the upper transfer guide 103*i* and the lower transfer guide 103*j*, the discharge preventing member 146 can be downsized. Further, the apparatus can be downsized.

(7) The discharge preventing member 146 is provided to thereby prevent the discharge to the main body electrical contacts 161*a*, 163*a* and 164*a*, whereby the withstand pressure of the electric circuit of the apparatus main body A can be suppressed to be low. Accordingly, the cost of the electric circuit can be reduced.

Second Embodiment

A second embodiment of the present invention will now be described with reference to FIGS. 16 to 19. The basic constructions of an image forming apparatus 100 and a cartridge B according to the present embodiment are similar to those described in the first embodiment. Accordingly, in the present embodiment, constituent portions differing from those in the first embodiment will be described, and members having the same or corresponding constructions and functions are given the same reference numerals and the description of the previous embodiment is invoked.

Figure 16:
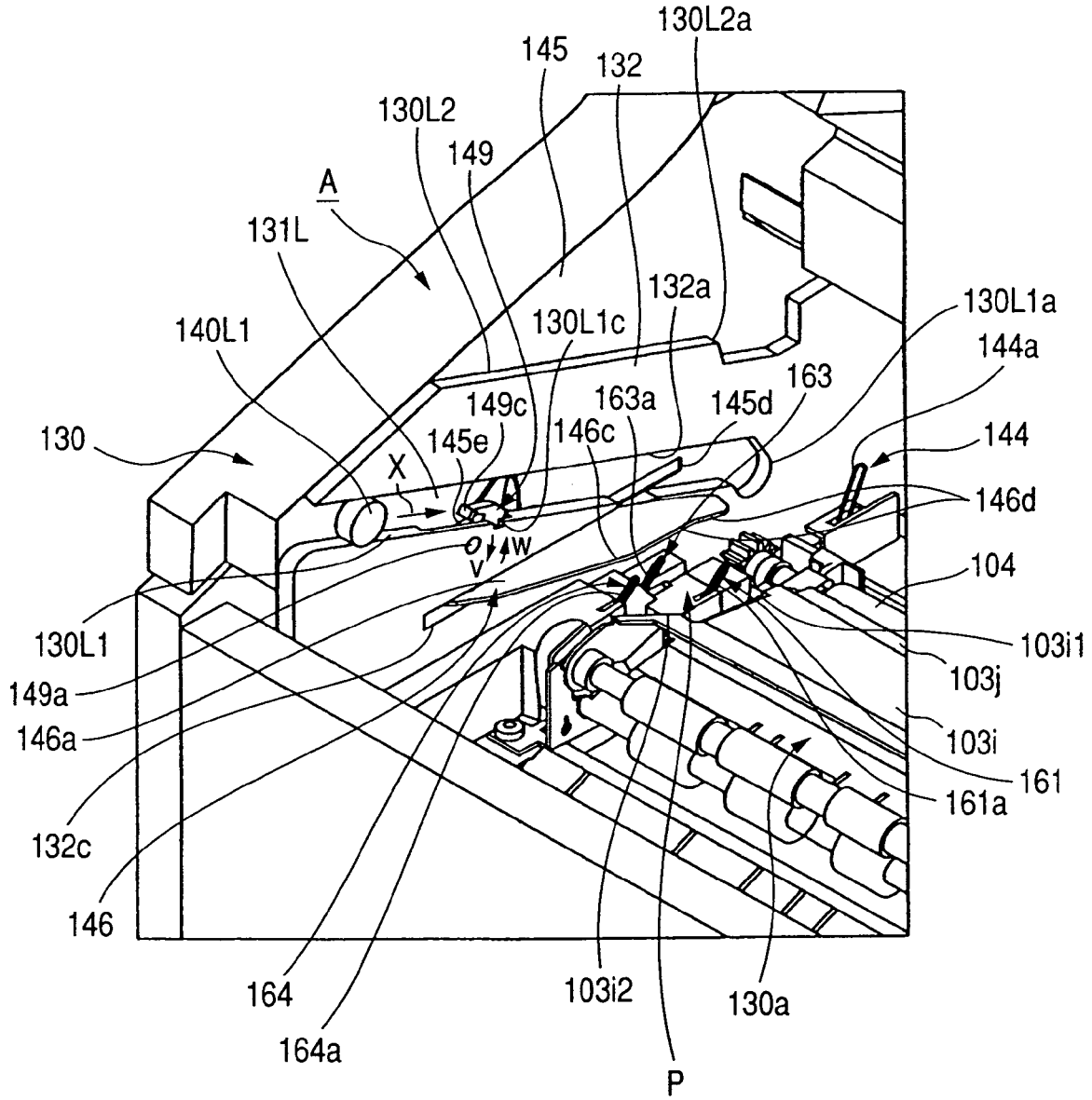
FIG. 16 is a perspective view showing the cartridge mounting portion and discharge preventing member of an image forming apparatus according to another embodiment of the present invention.

FIG. 16 shows the interior of the apparatus main body A of the image forming apparatus 100 according to the present embodiment. The transfer roller 104, the upper transfer guide 103*i*, the lower transfer guide 103*j*, the charging output electrical contact 144*a*, the developing output electrical contact 161*a*, the first main body remaining amount detecting contact 163*a* and the second main body remaining amount detecting contact 164*a* are provided as in the first embodiment. The discharge preventing member 146 is also provided as in the first embodiment (but in the present embodiment, the arm portion 146*b* is not provided).

In the present embodiment, the construction and operation of the actuating member for moving the discharge preventing member 146 between the first position and the second position differ from those in the first embodiment. A description will hereinafter be provided in detail.

Figure 17:
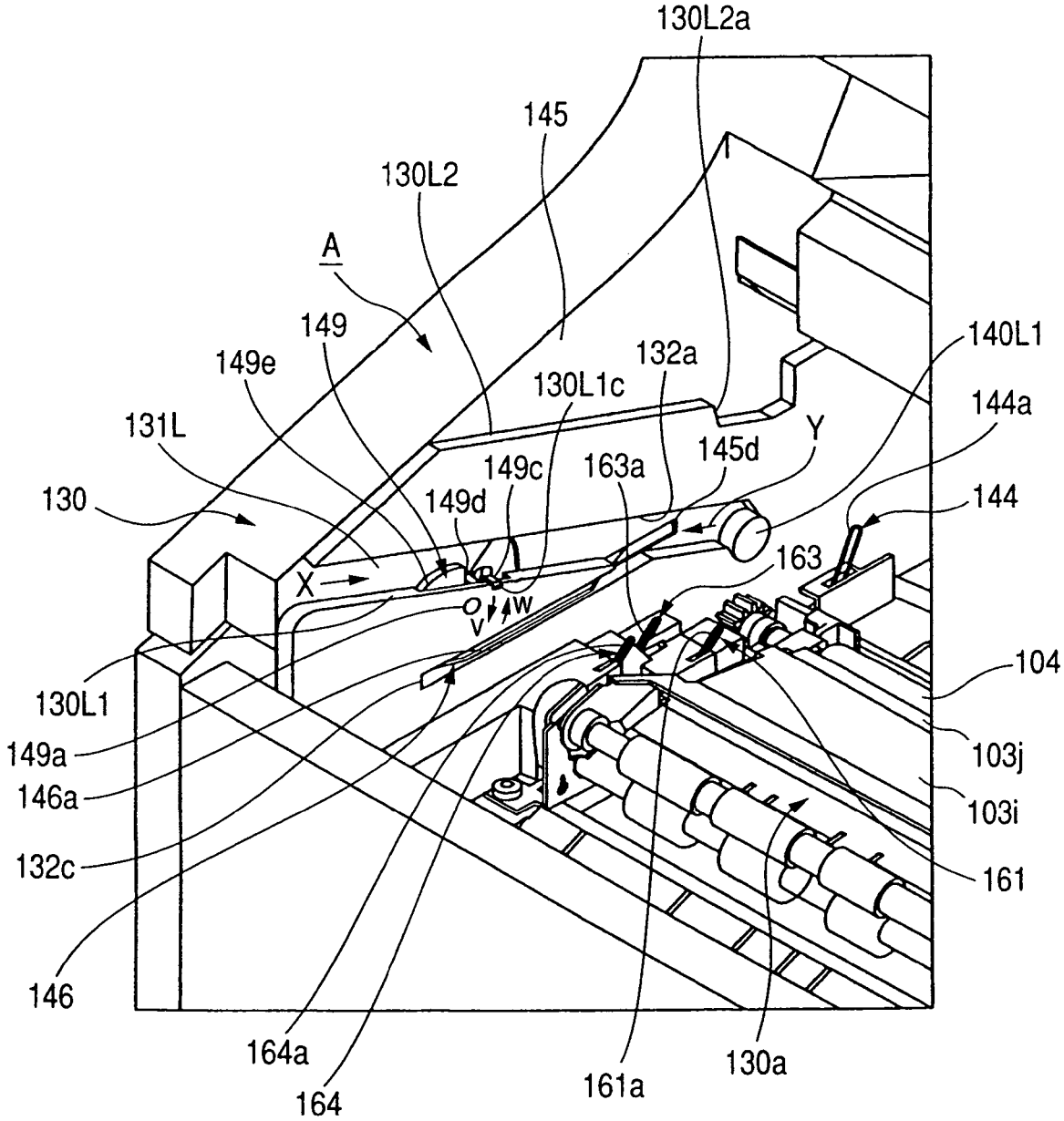
FIG. 17 is a perspective view showing the cartridge mounting portion and discharge preventing member of the image forming apparatus according to another embodiment of the present invention.
Figure 18:
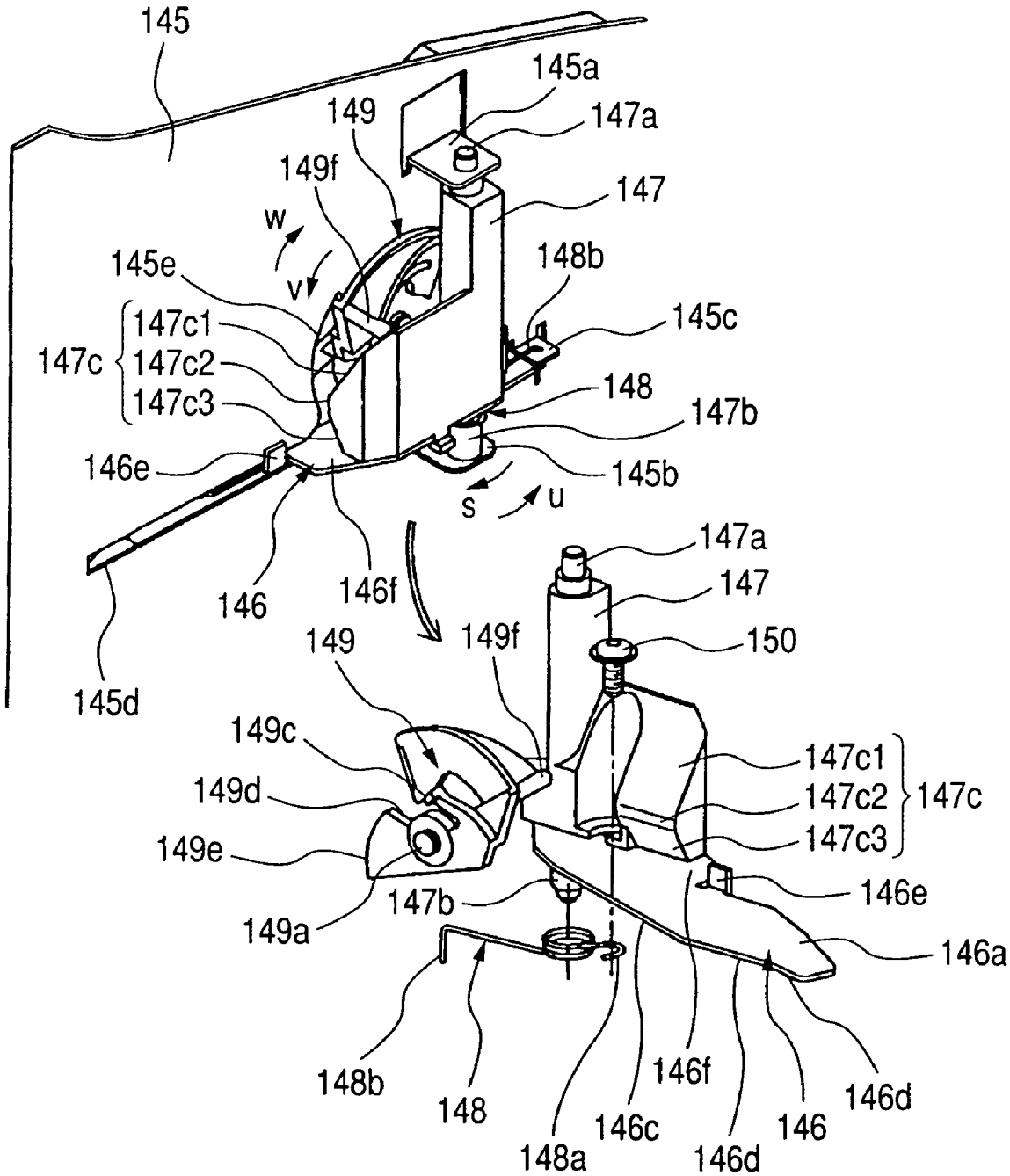
FIG. 18 is a perspective view of the vicinity of a discharge preventing member mounting portion for illustrating the construction of the discharge preventing member of the image forming apparatus according to another embodiment of the present invention.
Figure 19:
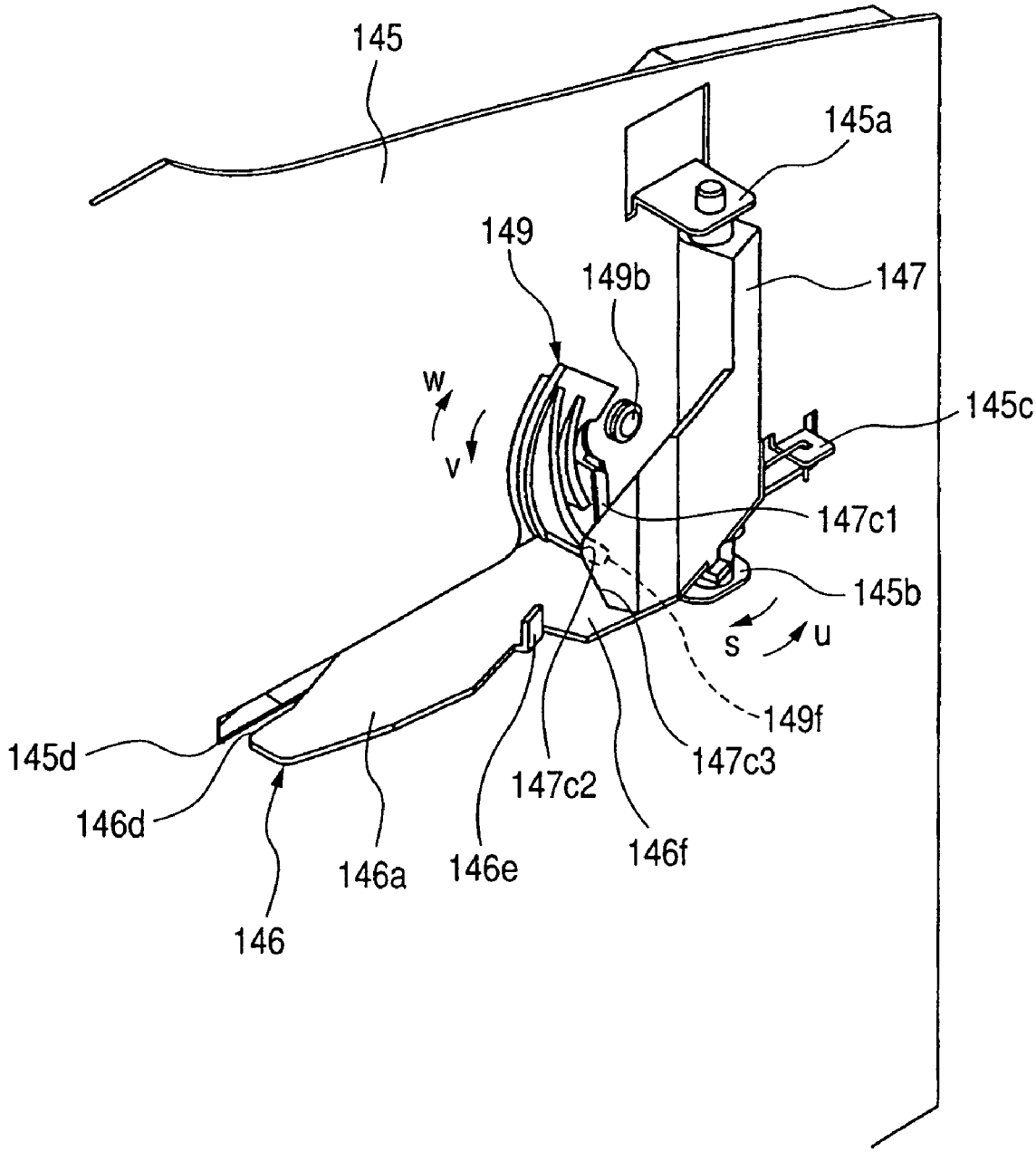
FIG. 19 is a perspective view of the vicinity of the discharge preventing member mounting portion for illustrating the operation of the discharge preventing member of the image forming apparatus according to another embodiment of the present invention.

FIGS. 16 and 17 are perspective views showing the interior of the apparatus main body A on a side on which the discharge preventing member 146 is provided. Also, FIGS. 18 and 19 are views of the apparatus main body A as it is seen from the outer side of a side plate (the opposite side of the cartridge mounting portion 130*a* with respect to the side plate 145 of FIGS. 16 and 17). FIGS. 16 and 18 show the position (first position) of the discharge preventing member 146 when the cartridge B is not mounted on the apparatus main body A. Also, FIGS. 17 and 19 show the position (second position) of the discharge preventing member 146 when the cartridge B is mounted on the apparatus main body A. In FIGS. 16 and 17, in order to facilitate understanding, the cartridge B has only the first left cartridge guide 140 L1 thereof shown. Also, in FIG. 18, there is also shown an assembly view of the discharge preventing member 146 and an actuating member which will be described later as they are seen from the side plate 145.

In the present embodiment, as the actuating member for moving the discharge preventing member 146 in operative association with the mounting and dismounting of the cartridge B, there are provided a lever 149 as a first actuating member and a supporting member 147 as a second actuating member.

The lever 149 is mounted for pivotal movement about shaft portions 149*a* (FIG. 18) and 149*b* (FIG. 19) substantially perpendicular to the plane of the side wall 145. The shaft portions 149*a* and 149*b* are mounted in mounting holes (not shown) formed in the side wall. Also, in the present embodiment, the lever 149 has a first abutting portion 149*c*, a second abutting portion 149*d* and a third abutting portion 149*e* as actuating member abutting portions abutting against a cartridge abutting portion (the first left cartridge guide 140L1) provided in the cartridge B. The first, second and third abutting portions 149*c*, 149*d* and 149*e* are provided in the order of the third, second and first abutting portions 149*e*, 149*d* and 149*c* as viewed in a rotational direction forward relative to the mounting direction X of the cartridge B centering around the shaft portions 149*a* and 149*b* of the lever 149. Also, the lever 149 is provided with a projection 149*f* as a drive transmitting portion for transmitting a driving force between it and the lever 149. The projection 149*f* abuts against a cam 147*c* which will be described later provided on the supporting member 147. Also, the projection 149*f* is provided along an outward direction substantially perpendicular to the plane of the side plate 145.

The lever 149 is disposed so that the first, second and third abutting portions 149*c*, 149*d* and 149*e* may be sandwiched between the side plate 145 and a first main body guide 130L1 formed on an inner side plate 132. The first, second and third abutting portions are disposed between the side plate 145 and the inner side plate 132 through a hole 145*e* formed in the side plate.

As in the first embodiment, the discharge preventing member 146 is fixed to the supporting member 147 by a screw 150 in a holding portion 146*f*. Further, the discharge preventing member 146 is rotatably mounted on the side plate 145. A torsion coil spring 148 is also provided as in the first embodiment. The torsion coil spring 148 biases the supporting member 147 (and the discharge preventing member 146) in the direction of arrow S. That is, the torsion coil spring 148 biases the supporting member 147 toward the interior of the cartridge mounting portion 130*a*.

In the present embodiment, on a portion of the supporting member 147, there is formed a cam 147*c* as a drive transmitting portion for transmitting a driving force between it and the projection 149*f* of the lever 149. The cam 147*c* has a first slope 147*c*1, a second slope 147*c*3 and a vertex 147*c*2. The first slope 147*c*1 and the second slope 147*c*3 inclinedly provided so as to be convex toward the side plate 145 continue to each other at the vertex 147*c*2.

A description will now be provided of the operation of the discharge preventing member 146 when the cartridge B is mounted and dismounted with respect to the apparatus main body A.

When the cartridge B is to be mounted on the apparatus main body A, the first left cartridge guide 140L1 is inserted in the direction of arrow X along the first left main body guide 130L1 (FIG. 16). At this time, the first abutting portion 149*c* protrudes from the first left main body guide 130L1. In this state, the first abutting portion 149*c* is located at a position at which it can abut against the first left cartridge guide 140L1. Then, the first left cartridge guide 140L1 as a cartridge abutting portion pushes the first abutting portion 149*c*. Thereby, the lever 149 is rotated in the direction of arrow v (i.e., a forward direction relative to the insertion direction X of the cartridge B (FIG. 16)). Thereby, the first slope 147*c*1 of the cam 147*c* is moved along the projection 149*f* of the lever 149. Therewith, the supporting member 147 and the discharge preventing member 146 are rotated in the direction of arrow u (FIG. 18). Then, the discharge preventing member 146 begins to retract from the cartridge mounting portion 130*a*. That is, the discharge preventing member 146 begins to retract from the first position (initial position) in the entry route of the cartridge B.

When the first left cartridge guide 140L1 passes, the lever 149 is biased in the direction of arrow v (i.e., a forward direction relative to the insertion direction X of the cartridge B). Then, the position of the lever 149 is regulated in a position wherein the first abutting portion 149*c* is fitted in a recess 130L1*c* formed in the first left main body guide 130L1 (FIG. 17). That is, with the mounting of the cartridge B, the discharge preventing member 146 retracts from the cartridge mounting portion 130*a*. Then, the discharge preventing member 146 is held in the second position (retracted position) outside the entry route of the cartridge B.

When the cartridge B is to be taken out of the apparatus main body A, the first left cartridge guide 140L1 is moved in the direction of arrow Y along the first left main body guide 130L1 (FIG. 17). At this time, the discharge preventing member 146 is in the second position. At this time, the second abutting portion 149*d* of the lever 149 protrudes from the first left main body guide 130L1. In this state, the second abutting portion 149*d* is located in a position in which it can abut against the first left cartridge guide 140L1. Accordingly, with the taking-out operation of taking out the cartridge B, the first left cartridge guide 140L1 pushes the second abutting portion 149*d* of the lever 149. Accordingly, the lever 149 is rotated in the direction of arrow w (i.e., a forward direction relative to the taking-out direction Y of the cartridge B). Thereby, the projection 149*f* and the cam 147*c* perform an operation converse to that during the mounting of the cartridge, and the discharge preventing member 146 is returned to the first position (FIGS. 16 and 18).

Thus, again in the present embodiment, when a charged foreign substance has entered the interior of the apparatus main body A on which the cartridge B is not mounted, discharge can be prevented from occurring between the foreign substance and the main body electrical contacts 161*a*, 163*a*, 164*a*. The discharge preventing member 146 is electrically grounded, and is electrically conductive. The discharge preventing member 146 is movable between the first position located in the entry route of the cartridge B and the second position retracted from the first position and located outside the entry route. Also, as an actuating member for moving the discharge preventing member 146 from the first position to the second position, there are provided the lever 149 (first actuating member) and the supporting member 147 (second actuating member). The lever 149 and the supporting member 147 abut against the cartridge B to thereby actuate when the cartridge B is mounted in the apparatus main body A. Thus, the lever 149 and the supporting member 147 move the discharge preventing member 146 from the first position to the second position.

Also, in the present embodiment, the lever 149 as the actuating member has a first abutting portion 149*c* and a second abutting portion 149*d* abutting against the first left cartridge guide 140L1. The first abutting portion 149*c* is located in a position at which it can abut against the first left cartridge guide 140L1 when the discharge preventing member 146 is in the first position. The first abutting portion 149*c* abuts against the first left cartridge guide 140L1 when the cartridge B is mounted. Subsequently, the first abutting portion 149*c* moves the lever 149 and the supporting member 147. Thereby, the first abutting portion 149*c* moves the discharge preventing member 146 from the first position to the second position. Also, the second abutting portion 149*d* is located in a position wherein it can abut against the first left cartridge guide 140L1 when the discharge preventing member 146 is in the second position. The second abutting portion 149*d* abuts against the first left cartridge guide 140L1 when the cartridge B is taken out. Subsequently, it moves the lever 149 and the supporting member 147. Thereby, the second abutting portion 149*d* moves the discharge preventing member 146 from the second position to the first position. That is, the discharge preventing member 146 is moved from the first position to the second position in operative association with the mounting operation of mounting the cartridge B on the apparatus main body A. The discharge preventing member 146 is moved from the second position to the first position in operative association with the taking-out operation of taking the cartridge B out of the apparatus main body A.

In the present embodiment, even when for example, the operator has moved the discharge preventing member 146 to the second position (the position shown in FIGS. 17 and 19) by mistake in a state in which the cartridge B is not mounted, the cartridge B can be mounted without any special operation being performed.

That is, when as shown in FIGS. 17 and 19, the discharge preventing member 146 is in the second position, the second abutting portion 149*d* protrudes from the first left main body guide 130L1. At the same time, an arcuate third abutting portion 149*e*, continuous from the second abutting portion 149*d*, also protrudes. In this state, the third abutting portion 149*e* is located in a state in which it can abut against the cartridge guide 140L1.

In order to mount the cartridge B in this state, the first left cartridge guide 140L1 is inserted in the direction of arrow X along the first left main body guide 130L1. Thereupon, the first left cartridge guide 140L1 depresses the third abutting portion 149*e*, whereby the lever 149 is rotated in the direction of arrow w (i.e., a direction opposite to the insertion direction X of the cartridge B). Then, the discharge preventing member 146 is returned to the first position (the position shown in FIGS. 16 and 18). At the same time, the first abutting portion 149*c* is returned to a state in which it can abut against the cartridge guide 140L1.

When the cartridge B is further inserted, the first abutting portion 149*c* abuts against the first left cartridge guide 140L1. Then, by the aforedescribed operation, the discharge preventing member 146 is again moved to the second position (the position shown in FIGS. 17 and 19).

That is, in the present embodiment, the lever 149 as the actuating member has the third abutting portion 149*e* in addition to the first and second abutting portion 149*c* and 149*d*. The third abutting portion 149*e* is in a position in which it can abut against the first left cartridge guide 140L1 in a state in which the cartridge B is not mounted on the apparatus main body A and when the discharge preventing member 146 is in the second position. When the cartridge B is to be mounted, the third abutting portion 149*e* abuts against the first left cartridge guide 140L1 and moves the lever 149 and the supporting member 147. Thereby, the discharge preventing member 146 is returned from the second position to the first position. As the result, the first abutting portion 149*c* is returned to the position in which it can abut against the first left cartridge guide 140L1.

Thus, even when the cartridge B is not mounted in the apparatus main body A and the discharge preventing member 146 is in the second position, the operator can mount the cartridge B without performing any special operation. However, the above-described construction in which the third abutting portion 149*e* is provided and the discharge preventing member 146 is returned from the second position to the first position is not requisite in the present embodiment.

As in the present embodiment, when the cartridge B is to be taken out of the apparatus main body A, the actuating member abutting portion and the cartridge abutting portion abut against each other, whereby the actuating member actuates. Thereby, the discharge preventing member 146 can be returned from the second position to the first position. That is, the resilient acting member (torsion coil spring) 148 used in the first embodiment and the present embodiment is not requisite. For example, the frictional sliding force of the actuating member (the supporting member 147 or the supporting member 147 and the lever 148) is made great or a snap fit or the like is provided, whereby the actuating member can be held so that the discharge preventing member, 146 may be held in the second position.

Besides, in the present embodiment, as the disposition mode of the discharge preventing member 146 and the disposition mode of the upper transfer guide 103*i*, which is a conveying guide for the recording medium, those described in the first embodiment can likewise be applied.

In the present embodiment, as shown in FIG. 16, the distance between the upstream side end surface 146*d* of the discharge preventing member 146 and the downstream side end surface 103*i*1, and the distance between the downstream side end surface 146*c* of the discharge preventing member 146 and the upstream side end surface 103*i*2 of the upper transfer guide 103*i* are 15 mm to 20 mm. Let it be assumed here that the thickness of the operator's fingers is a diameter of about 15 mm. Let it also be assumed that the operator's charged fingers have passed through the gap between the discharge preventing member 146 and the upper transfer guide 103*i* from the direction of arrow P. When the fingers come near the developing output electrical contact 161*a*, the first main body remaining amount detecting contact 163*a* and the second main body remaining amount detecting contact 164*a*, the fingers approach the discharge preventing member 146 or the upper transfer guide 103*i* to a degree of 2.5 mm.

The design of the device is made such that at this time, the distances between the fingers and the developing output electrical contact 161*a*, the first main body remaining amount detecting contact 163*a*, and the second main body remaining amount detecting contact 164*a* are 2.5 mm or greater (in the present embodiment, about 10 mm). Thus, if the charging voltage of the operator (his fingers) is about 2.5 kV or greater, discharge will occur between the fingers and the discharge preventing member 146 or the upper transfer guide 103*i*. Consequently, the withstand pressure of the electric circuit is set so that the electric circuit of the apparatus main body A may not be damaged by the discharge of the order of 2.5 kV. Thereby, the damaging of the electric circuit of the apparatus main body A can be prevented. As described above, by the discharge preventing member 146 being provided, the withstand pressure of the electric circuit can be suppressed low and therefore, the cost of the electric circuit can be reduced.

Thus, again by adopting the construction of the present embodiment, an effect similar to that of the aforedescribed first embodiment can be obtained.

Further, in the present embodiment, even if the operator moves the discharge preventing member 146 to the retracted position by mistake when the cartridge B is not mounted on the apparatus main body A, the cartridge B can be mounted without any special operation being performed while keeping the state intact.

According to the present invention, when a charged foreign substance has entered an electrophotographic image forming apparatus on which a process cartridge is not mounted, discharge can be prevented from occurring between the foreign substance and main body electrical contacts provided in the apparatus main body.

Also, according to the present invention, it never happens that electrostatic noise is applied to the main body electrical contacts, and the destruction of electrical elements provided in the electric circuit can be prevented, whereby the damaging of the electric circuit provided in the apparatus main body can be prevented.

Also, according to the present invention, man's sweat or grease or the like in the apparatus main body can be prevented from adhering to the main body electrical contacts to thereby cause faulty conduction, and the reliability of the electrical connection between the cartridge electrical contacts and the main body electrical contacts can be improved.

Also, according to the present invention, the operator need not perform any special operation, and the discharge to the main body electrical contacts and the damaging of the electric circuit of the apparatus main body thereby can be prevented, and the reliability of the electrical connection between the cartridge electrical contacts and the main body electrical contacts can be improved.

While the invention has been described with reference to the structure disclosed herein, it is not confined to the details set forth and this application is intended to cover such modifications or changes as may come within the purposes of the improvements or the scope of the following claims.

What is claimed is:

1. A process cartridge detachably mountable on an apparatus main body of an electrophotographic image forming apparatus for forming an image on a recording material, said process cartridge comprising:

an electrophotographic photosensitive drum;

a developing roller, which develops an electrostatic latent image formed on said electrophotographic photosensitive drum;

a driving force receiving portion, which receives from the apparatus main body a driving force for rotating said electrophotographic photosensitive drum in a state in which said process cartridge is mounted on the apparatus main body, said driving force receiving portion being disposed on one end portion of said process cartridge in a longitudinal direction thereof;

a developing bias contact, which receives from the apparatus main body a developing bias to be applied to said developing roller in the state in which said process cartridge is mounted on the apparatus main body, said developing bias contact being disposed on the other end portion of said process cartridge in the longitudinal direction thereof;

a first cartridge guide to be guided by a first main body guide disposed in the apparatus main body when said process cartridge enters the apparatus main body, said first cartridge guide to be guided being disposed at said one end portion of said process cartridge; and guiding means for being guided by a second main body guide disposed in the apparatus main body when said process cartridge enters the apparatus main body, said guiding means being disposed at the other end portion of said process cartridge in the longitudinal direction thereof, said guiding means comprising means for moving a grounded electrically conductive member disposed in the apparatus main body from a position in an entry route, along which said process cartridge enters the apparatus main body, to a position out of the entry route when said process cartridge enters the apparatus main body by being brought into contact with a first abutting portion of an actuating member disposed in the apparatus main body when said process cartridge enters the apparatus main body, and for moving the grounded electrically conductive member from the position out of the entry route to the position in the entry route when said process cartridge is removed from the apparatus main body by being brought into contact with a second abutting portion of the actuating member when said process cartridge is removed from the apparatus main body.

2. A process cartridge according to claim 1, wherein said guiding means is disposed downstream of said developing bias contact in an entry direction along which said process cartridge enters the apparatus main body.

3. A process cartridge according to claim 1 or 2, further comprising a first detecting electrical contact and a second detecting electrical contact, which are disposed on the other end portion of said process cartridge on which said developing bias contact is disposed, said first detecting electrical contact receiving a voltage from the apparatus main body and said second detecting electrical contact outputting a detection signal to the apparatus main body in order that the remaining amount of developer in said process cartridge is detected in the apparatus main body.

4. A process cartridge according to claim 3, wherein when the electrically conductive member moved by said guiding means is in the position in the entry route, the electrically conductive member is positioned above at least a part of a developing output electrical contact electrically connected to said developing bias contact, a first main body detecting electrical contact electrically connected to said first detecting electrical contact, and a second main body detecting electrical contact electrically connected to said second detecting electrical contact.

5. A process cartridge detachably mountable on an apparatus main body of an electrophotographic image forming apparatus for forming an image on a recording material, said process cartridge comprising:

an electrophotographic photosensitive drum;

process means for acting on said electrophotographic photosensitive drum;

a driving force receiving portion, which receives from the apparatus main body a driving force for rotating said electrophotographic photosensitive drum in a state in which said process cartridge is mounted on the apparatus main body, said driving force receiving portion being disposed on one end portion of said process cartridge in a longitudinal direction thereof;

a bias contact, which receives from the apparatus main body a bias to be applied to said process means in the state in which said process cartridge is mounted on the apparatus main body, said bias contact being disposed on the other end portion of said process cartridge in the longitudinal direction thereof; and contact means disposed on the other end portion of said process cartridge for moving an electrically conductive member disposed in the apparatus main body from a position in an entry route, along which said process cartridge enters the apparatus main body, to a position out of the entry route when said process cartridge enters the apparatus main body by contacting a first abutting portion of a grounded actuating member disposed in the apparatus main body when said process cartridge enters the apparatus main body, and for moving the electrically conductive member from the position out of the entry route to the position in the entry route when said process cartridge is removed from the apparatus main body by contacting a second abutting portion of the actuating member when said process cartridge is removed from the apparatus main body.

6. A process cartridge according to claim 5, wherein said contact means is disposed downstream of said bias contact in an entry direction along which said process cartridge enters the apparatus main body.

7. A process cartridge according to claim 5 or 6, further comprising a first detecting electrical contact and a second detecting electrical contact, which are disposed on the other end portion of said process cartridge on which said bias contact is disposed, said first detecting electrical contact receiving a voltage from the apparatus main body and said second detecting electrical contact outputting a detection signal to the apparatus main body in order that the remaining amount of developer in said process cartridge is detected in the apparatus main body.

8. A process cartridge according to claim 7, wherein when the electrically conductive member moved by said contact means is in a position in the entry route, the electrically conductive member is positioned above at least a part of a developing output electrical contact electrically connected to said bias contact, a first main body detecting electrical contact electrically connected to said first detecting electrical contact, and a second main body detecting electrical contact electrically connected to said second detecting electrical contact.

9. A process cartridge according to claim 5 or 6, wherein said contact means is a cartridge guide to be guided by a main body guide disposed in the apparatus main body when said process cartridge enters the apparatus main body, said cartridge guide to be guided being disposed at the other end portion of said process cartridge in the longitudinal direction thereof.

10. A process cartridge detachably mountable on an apparatus main body of an electrophotographic image forming apparatus for forming an image on a recording material, said process cartridge comprising:

an electrophotographic photosensitive drum;

process means for acting on said electrophotographic photosensitive drum;

a driving force receiving portion, which receives from the apparatus main body a driving force for rotating said electrophotographic photosensitive drum in a state in which said process cartridge is mounted on the apparatus main body;

a bias contact, which receives from the apparatus main body a bias to be applied to said process means in the state in which said process cartridge is mounted on the apparatus main body; and contact means disposed on the other end portion of said process cartridge for moving an electrically conductive member disposed in the apparatus main body from a position in an entry route, along which said process cartridge enters the apparatus main body, to a position out of the entry route when said process cartridge enters the apparatus main body by contacting a first abutting portion of a grounded actuating member disposed in the apparatus main body when said process cartridge enters the apparatus main body, and for moving the electrically conductive member from the position out of the entry route to the position in the entry route when said process cartridge is removed from the apparatus main body by contacting a second abutting portion of the actuating member when said process cartridge is removed from the apparatus main body.

11. A process cartridge according to claim 10, wherein said contact means is disposed downstream of said bias contact in an entry direction along which said process cartridge enters the apparatus main body.

12. A process cartridge according to claim 10 or 11, further comprising a first detecting electrical contact and a second detecting electrical contact, said first detecting electrical contact receiving a voltage from the apparatus main body and said second detecting electrical contact outputting a detection signal to the apparatus main body in order that the remaining amount of developer in said process cartridge is detected in the apparatus main body.

13. A process cartridge according to claim 12, wherein when the electrically conductive member moved by said contact means is in a position in the entry route, the electrically conductive member is positioned above at least a part of a developing output electrical contact electrically connected to said bias contact, a first main body detecting electrical contact electrically connected to said first detecting electrical contact, and a second main body detecting electrical contact electrically connected to said second detecting electrical contact.

14. A process cartridge according to claim 10 or 11, wherein said contact means is a cartridge guide to be guided by a main body guide disposed in the apparatus main body when said process cartridge enters the apparatus main body, said cartridge guide to be guided being disposed at the other end portion of said process cartridge in a longitudinal direction thereof.

15. A process cartridge according to claim 10 or 11, wherein said process means is a developing roller, which develops an electrostatic latent image formed on said electrophotographic photosensitive drum by use of developer, and said bias contact is a developing bias input contact, which supplies the bias from the apparatus main body to said developing roller.

* * * * *